US005784088A

United States Patent [19]

Ujita et al.

[11] Patent Number: 5,784,088

[45] Date of Patent: Jul. 21, 1998

[54] INK JET RECORDING APPARATUS USING RECORDING UNIT WITH INK CARTRIDGE HAVING INK INDUCING ELEMENT

[75] Inventors: Toshihiko Ujita, Yamoto; Masanori Takenouchi, Yokohama; Keiichiro Tsukuda, Kawasaki, all of Japan

[73] Assignee: Canon Kabushiki Kaisha, Tokyo, Japan

[21] Appl. No.: 669,644

[22] Filed: Jun. 24, 1996

Related U.S. Application Data

[63] Continuation of Ser. No. 165,843, Dec. 14, 1993, abandoned.

[30] Foreign Application Priority Data

| | | | |
|---|---|---|---|
| Jul. 20, 1993 | [JP] | Japan | 5-179195 |
| Nov. 29, 1993 | [JP] | Japan | 5-298370 |
| Nov. 29, 1993 | [JP] | Japan | 5-298500 |
| Nov. 29, 1993 | [JP] | Japan | 5-298501 |

[51] Int. Cl.[6] ..... B41J 2/175

[52] U.S. Cl. ..... 347/86; 347/87; 347/93

[58] Field of Search ..... 347/86, 87, 85, 347/93

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,368,478 | 1/1983 | Koto | 347/86 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,700,202 | 10/1987 | Kuranishi et al. | 347/86 |
| 4,723,129 | 2/1988 | Endo et al. | 346/1.1 |
| 4,740,796 | 4/1988 | Endo et al. | 346/140 R |
| 5,126,767 | 6/1992 | Asai | 347/86 |
| 5,155,502 | 10/1992 | Kimura et al. | 346/140 R |
| 5,216,450 | 6/1993 | Koitabashi et al. | 346/140 R |
| 5,237,342 | 8/1993 | Saikawa et al. | 346/140 R |

FOREIGN PATENT DOCUMENTS

| | | | |
|---|---|---|---|
| 0477828 | 4/1992 | European Pat. Off. | C12N 15/74 |
| 0488829 | 6/1992 | European Pat. Off. . | |
| 0510665 | 10/1992 | European Pat. Off. . | |
| 0536980 | 4/1993 | European Pat. Off. . | |
| 0546832 | 6/1993 | European Pat. Off. . | |
| 0571151 | 11/1993 | European Pat. Off. . | |
| 59-123670 | 7/1984 | Japan . | |
| 59-138461 | 8/1984 | Japan . | |
| 196262 | 11/1984 | Japan | 347/93 |
| 02187364 | 7/1990 | Japan . | |
| 288652 | 12/1991 | Japan | 347/86 |
| 7157 | 1/1992 | Japan | 347/86 |
| 4101097 | 4/1992 | Japan | F04C 29/00 |
| 493978 | 7/1992 | Japan | 347/86 |
| 77438 | 3/1993 | Japan | 347/86 |
| 5096742 | 4/1993 | Japan . | |
| 5104735 | 4/1993 | Japan . | |
| 5162329 | 6/1993 | Japan | B41J 2/175 |
| 169673 | 7/1993 | Japan | 347/86 |
| 5238016 | 9/1993 | Japan . | |
| 5293970 | 11/1993 | Japan | B41J 2/175 |

*Primary Examiner*—Valerie Lund

*Attorney, Agent, or Firm*—Fitzpatrick, Cella, Harper & Scinto

[57] ABSTRACT

An ink cartridge (3) including an ink reservoir portion having a porous member (37) for storing ink and an ink supply portion (39) has an ink inducing element (47) disposed between the ink reservoir portion and the ink-supply portion (39). The ink inducing element (47) is made of bundle of fibers in which each fiber is disposed in parallel to the direction of ink supplying from the ink reservoir to the ink supply portion (39), and one end of the ink inducing element (47) is press-touched to the porous member (37).

44 Claims, 24 Drawing Sheets

INK JET RECORDING APPARATUS USING RECORDING UNIT WITH INK CARTRIDGE HAVING INK INDUCING ELEMENT

This application is a continuation of application Ser. No. 08/165,843 filed Dec. 14, 1993, now abandoned.

BACKGROUND OF THE INVENTION

1. Field of the Invention

The present invention relates to an ink-jet recording apparatus, and more particularly to an ink cartridge (hereinafter also referred to as an ink tank) for storing ink to be supplied to an ink-jet head, a recording unit which integrally includes the ink cartridge and the ink-jet head, which are removably connected with each other, and the ink-jet recording apparatus on which the recording unit can be removably mounted. In the following description, the term "record" includes a meaning of printing characters, images or the like on cloth, paper, plastic sheet, or the like.

2. Description of Related Art

Several types of recording apparatuses on which a recording head of one's own method such as: wire-dot method; thermal recording method; thermal-transfer method; and ink-jet method, is mounted, and which record characters, images or the like on a recording medium such as a paper, have been proposed. Among these methods, the ink-jet recording method is one of non-impact methods and includes the steps of ejecting ink droplets and depositing these ink droplets on the recording medium. Thereby, a recording apparatus using a recording unit of this method can perform recording with high-speed and high-density. As a result, they have been provided as printers as output terminals of an information processing systems e.g., copying machines, facsimiles, printing machines, word processors, work stations, or the like; or they have been provided as handy- or portable-printers of personal computers, host computers, optical disc- or video equipment or the like.

In the case of that the ink-jet recording apparatus is used in these system, the ink-jet recording apparatus is constructed so as to accord with respective Particular function and condition for use of these systems. To miniaturize a size of the information processing system is one of main current demand Accordingly, the recording unit and the main body of the ink-jet recording apparatus using this unit are demanded to be miniaturized.

While such a miniaturizing is realized on an actual apparatus base, however, it is need for the recording unlit or the like to maintain performance which have been known usually in the unit or to have further performance. In order to answer these demands, there have been proposed various recording units and various recording apparatuses in which this unit is mounted.

One of the embodiments is explained first with reference to FIG. 1.

In this figure, an ink-jet unit includes an ink-jet head 102 and an ink cartridge 101 as a reservoir for storing the fluid such as ink, which are removably connected to each other. The ink-jet unit is removably mounted on a carriage 121. Also the carriage 121 is movably attached to a guide shaft and a lead screw which are supported by a main frame 122 of the ink-jet recording apparatus 120.

It is noted what the ink-jet unit is not limited to the structure described above. That is, for example, there is an ink-jet unit having an ink cartridge integrally connected with the ink-jet head. In the case of using the former type of ink-jet head, the ink cartridge is of an interchangeable type while the ink-jet head is fixed or removably mounted on the carriage.

In the case chat the recording head (ink-jet head) and the Ink cartridge are mounted on the carriage as described above, it is necessary to provide the ink cartridge with a mechanism of generating a negative pressure. In the description below, in general, the term "a negative pressure" is defined as a state of that a water head pressure of the ink is kept at a value lower than that of the atmospheric pressure enough to stop a leakage of ink from nozzles of the recording head. As a negative pressure generating mechanism provided in the ink carriage, a porous member as an ink absorbing member is used which generates a capillary force or the porous member. In the case of using the porous member, as disclosed in the documents such as Japanese Patent Application Laying-Open No.2-187364, the ink cartridge takes the construction of that the ink inlet portion of the recording head is press-inserted into the ink absorber or the ink cartridge for increasing an efficiency of using the ink, that is, for reducing the rest amount of the ink in the ink absorber.

According to the construction described above, the capillary force of the porous member can be locally increased by deforming the ink absorber at a part thereof around the ink-inlet portion and thereby the ink is induced to the neighborhood of the ink-inlet portion and ink supply is promoted so that the rest amount of ink in the ink absorber is decreased.

In the case of the removable type recording unit (ink-jet unit), there is a possibility that the user will change the empty ink cartridge with new one. Also, there is another possibility of changing the recording head with new one or filling up the empty ink cartridge with ink to use it again. Furthermore, there is a possibility of that the user will separate them oftener than he or she have to do. Therefore, it is difficult to predict the situation on which the recording head or the ink cartridge is detached and is mounted. At the stage of the separation or connection between them, therefore, the amount of air can be allowed to enter the ink cartridge and prevents an ink route from being formed between the recording head and the ink cartridge.

The removable type recording unit as disclosed in the Japanese Patent Application Laying-Open No. 2-187364, especially in the case of that the ink inlet portion of the recording head is press-inserted into the ink absorber for using the ink efficiently, has the following problems. That is, the present inventors find that the recording head is difficult to receive the ink from the ink cartridge generally in the case of after connecting the ink cartridge with the recording head, again before the ink cartridge is used up.

In this situation, the ink flow to the recording head cannot be often recovered by an ejection recovery operation with the step of sucking ink out of ejection port of the recording head and thus it is difficult to consume the ink completely. The present inventors make clear that the largest cause for such trouble in the situation described above is as follows.

FIGS. 2A and 2B illustrate one of the embodiments of the ink-jet recording apparatus for explaining such cause. FIG. 2A shows connected state of a recording head 2 with an ink cartridge 3, and FIG. 2B shows detached state of the former from the latter.

As shown in the figures, an ink-jet unit 4 is constituted by removably connecting the recording head 2 with the ink cartridge 3 by means of a pair of parallel connecting claws (not shown).

At the connection, the ink-inlet portion 40 of the recording head 2 is inserted into a cylindrical connecting portion 39 which is used as an ink supply portion. The ink path 36 can be isolated from the external atmosphere by means of the O-ring 35 which seals around the connected portion and which is made of ethylene propylene rubber or the like.

The porous member (i.e., an ink absorber such as a sponge material) 37 occupies the inner side of the ink cartridge 3 so as to store the ink to be supplied to the recording head 2. That is, the porous member has an ability of holding the ink.

Therefore, the density of the porous member is adjusted and a water-head pressure of the recording head 2 is kept to be and lower than that of the atmospheric pressure so as to avoid the ink leakage.

In the ink-jet recording head having the structure described above, a part of the ink absorber adjacent to the connecting portion 39 is directly subjected to the external atmosphere when the recording head 2 and the ink cartridge 3 are in the removed condition. In this case, while the deformed ink absorber 37 is coming back its original shape, the ink absorber 37 induces air so that the part 38 of the ink absorber 37 adjacent to the connecting portion 39 of the ink cartridge 3 can be filled with air bubbles or with (bubbling ink ) when the recording head 2 and the ink cartridge 3 are separated from each other.

In this state, when the recording head 2 is connected to the cartridge 3, the ink absorber 37 forms an air region in the part adjacent to the ink supply portion 39. Therefore, the aired region prevents an ink route E from being formed Furthermore the air in the ink supply portion can be compressed into the ink absorber by inserting the ink-inlet portion 40 of the recording head 2 into the ink cartridge 3 and the compressed air also prevents the ink route E from being formed Under these conditions, consequently, undesirable recording state can be caused as a result of decreased amount of ink flow or the interrupted ink route.

To solve the problems described above, mechanical devices for controlling the inflow of air into the ink route have been proposed in several documents, for the example the document of European Patent Application No. 536,980. This document discloses a fibrous sleeve in a part protruding from the recording head. A inner end of the sleeve communicates with the ink chamber of the head, while an external end thereof is in contact with an ink absorber of the ink reservoir when the recording head is connected with the ink reservoir. According to the structure described above, the sleeve functions as a filter and prevent air from being induced into the chamber of the recording head.

In this document however, there is no suggestion to solve the problem of that the air gets into the ink cartridge during the period of performing the separation and the re-connection between the recording head and the ink cartridge.

Furthermore, there is an idea of providing a valve mechanism for closing the ink outlet to prevent the influx of air into the ink path during the separation and the re-connection. Comparing with the conventional recording unit, however, a process of making the recording unit having the valve mechanism requires more cost of the production and more parts, and also the resulting product can be a large-sized one with a poor performance. This results decreasing of advantage of the removable type of the recording unit.

In addition to the problem of that the air gets easily into the ink cartridge during the period of separating and re-connecting the recording head, with the ink cartridge there remains another matters to be considered in the removable type of recording unit:

(i) the ink leaks from the ink connecting portion when the recording head is removed;

(ii) the appropriate amount or ink supply from the ink cartridge to the recording head; and (iii) an efficiency of using the ink stored in the ink cartridge.

Therefore, the present invention can solve many kind of problems described above which occur in the removable recording unit in which the recording head is detached from or connected to the ink cartridge.

SUMMERY OF THE INVENTION

The object of the present invention is to provide an ink cartridge with low cost and high reliability which prevent ink from leaking therefrom and stably supply ink after detaching and connecting between a recording head and an ink cartridge.

It is another object of the invention to provide an ink-jet recording unit having the ink cartridge described above.

It is a further object of the invention to provide an ink-jet recording apparatus using the recording unit with the ink cartridge described above.

In the first aspect of the present invention, there is provided an ink cartridge having an ink-reserving portion with a porous member for storing ink and an ink-supply portion for supplying ink from the ink-reserving portion to an outside of the ink cartridge, comprising:

an ink-inducing element which is arranged between the ink-reserving portion and the ink-supply portion, the inducing element being formed as a bundle of fibers in which each fiber is parallel to a direction of supplying the ink.

In the second aspect of the present invention, there is provided an ink cartridge having a porous member for storing ink to be supplied to a recording head through an ink-inlet portion of the recording head, comprising:

an ink-inducing element having a first end portion to be press-touched with the ink-inlet portion and a second end portion to be press-touched with the porous member, the ink-inducing element being formed as a bundle or fibers each of which is directed from the second end portion to the first end portion.

In the third aspect of the present invention, there is provided an ink cartridge comprising:

a porous member for storing ink; and an ink-supply portion which has an outlet used for supplying ink to an ink jet head and into which an ink inlet portion of the ink jet head; the ink-supply portion having an air path for letting air to be introduced into the ink cartridge from the ink-supply portion escape to the outside of the ink cartridge when the ink-inlet portion is inserted into the ink-supply portion.

In the fourth aspect of the present invention, there is provided an ink-jet recording apparatus mounting a recording unit which has a recording head with a plurality of ejection ports; and an ink cartridge having a porous member for storing ink, wherein the recording unit having an ink inlet portion for leading ink from the ink cartridge, and the ink cartridge having an ink inducing element one end of which is press-touched with the ink inlet portion and the other end of which is press-touched the ink absorber, and which is made of a bundle of fibers, a carriage being provided for detachably mounting the recording unit.

In the fifth aspect of the present invention, there is provided an ink-jet recording apparatus including an ink-jet recording unit which has a recording head for ejecting ink and an ink cartridge for storing, and performing recording by ejecting ink onto a recording medium, wherein the ink cartridge has an ink absorber for holding ink, and an ink inducing element disposed between the ink absorber and an outlet for supplying ink to outside, a capillary force of the ink inducing element is higher than that of the ink absorber, and also a pressure loss of the ink inducing element is 20 mmAq or under.

In the sixth aspect of the present invention, there is provided an ink jet recording apparatus using a recording unit which has a recording head for recording by ejecting ink and an ink cartridge for supplying ink to the recording head, the recording head and the ink cartridge are removably connected with each other, wherein the recording head has an ink inducing element which is press-touched to the ink cartridge and provided for receiving the ink supply, and wherein the ink cartridge has an ink absorber for storing ink to be supplied to the recording head, an ink supply portion into which an ink inlet of the recording head is inserted and which has outlet formed at front end of the ink cartridge, so as to constitute ink path communicating the ink inlet with the ink absorber, an ink inducing element one end of which is press-touched to the ink inlet inserted into the ink supply portion and another end of which is press-touched to the ink absorber, and an air communicating path disposed between the ink inducing element and a wall of the ink supply portion and provided for letting air to be introduced into the ink cartridge from the ink supply portion escape to an outside of the ink cartridge when the ink inlet portion is inserted into the ink supply portion.

In the seventh aspect of the present invention, there is provided an ink-jet recording unit including a recording head with a plurality of ejection ports for ejecting ink and an ink cartridge having a porous member for holding ink to be supplied to the recording head, wherein the recording head has an ink inlet for lead ink from the ink cartridge, and wherein the ink cartridge has an ink inducing element one end of which is press-touched to the ink inlet, another end of which is press-touched to the ink absorber, and which is made is made of a bundle of fibers in which each fiber is directed from the porous member to the ink inlet portion.

In the eighth aspect of the present invention, there is provided an ink-jet unit in which an ink jet head for ejecting ink and an ink cartridge for storing ink to be supplied to the ink jet head are removably connected with each other, wherein the ink cartridge has an ink absorber for holding stored ink, and an link inducing element disposed between the ink absorber and an outlet for supplying ink to an outside, a capillary force of the ink inducing element is higher than that of the ink absorber and a pressure loss of the ink inducing element is 20 mmAq or under, and an ink inlet of the ink jet head is touched to the ink inducing element.

In the ninth aspect of the present invention, there is provided a recording unit in which a recording head for recording by ejecting ink and an ink cartridge for supplying ink to the recording head which are removably connected with each other; wherein the recording head an ink inducing portion which is touched to the ink cartridge and is provided for receiving the ink supply one end of the ink inducing element being touched to the ink inlet inserted into the ink supply portion, and another end of the ink inducing element being press-touched to the ink absorber, and the ink cartridge has an ink absorber for storing ink to be supplied to the recording head, an ink supply portion into which an ink inlet so the recording head and which has an outlet formed on a front end of the ink cartridge, so as to form an ink supply route communicating the ink inducing element with the ink absorber, and air path for letting air escape to an outside, the air path being disposed between the ink inducing element and a wall of the ink supply portion when the receding head is connected with the ink cartridge.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention will be described in detail hereinafter with reference to one accompanying drawings which several preferred embodiments thereof.

<Embodiment 1>

Figure 1:
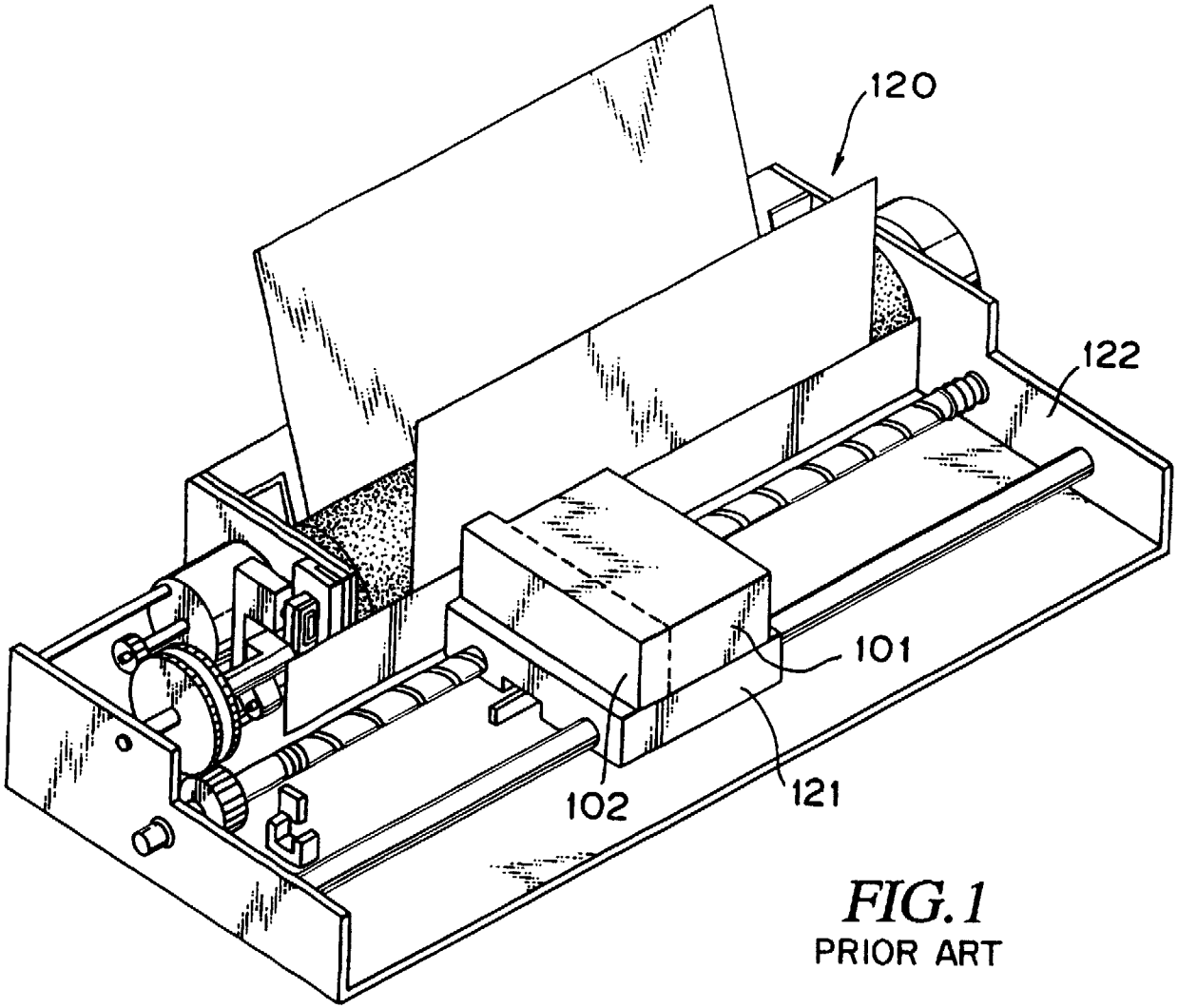
FIG. 1 PRIOR ART
FIG. 1 is a perspective view of an ink-jet recording unit concerned with the related art.
Figure 2A:
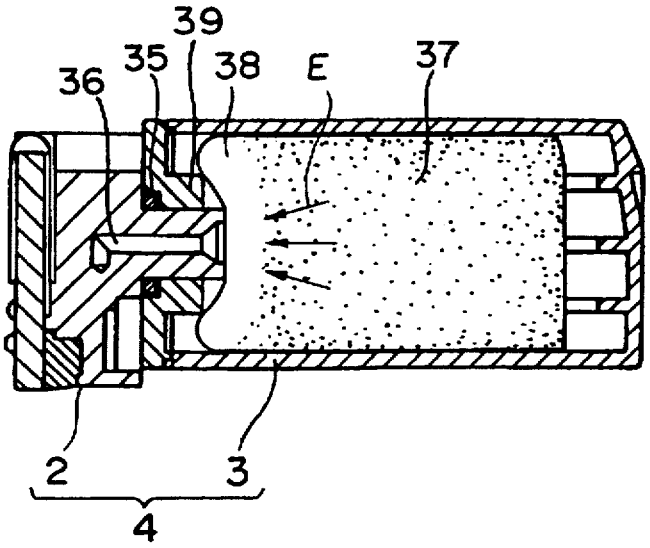
FIG.2A PRIOR ART
FIG. 2A is a cross sectional view of a conventional ink-jet recording unit in which a recording head is connected with an ink cartridge.
Figure 2B:
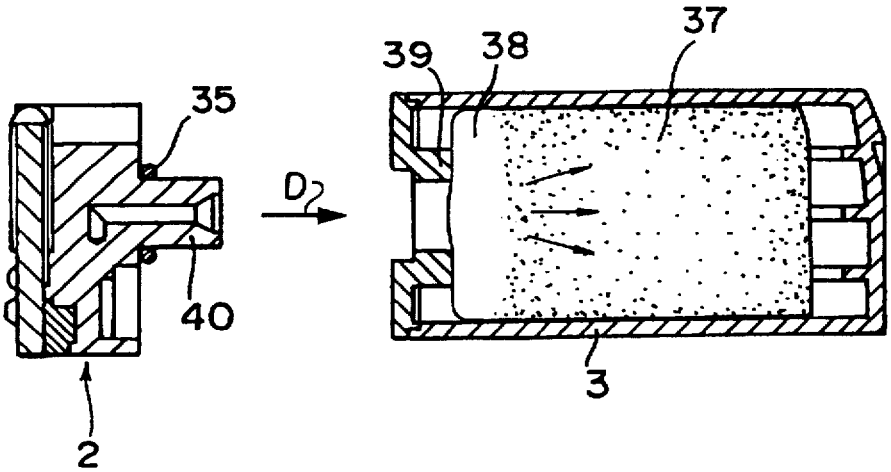
FIG.2B PRIOR ART
FIG. 2B is a cross sectional view of a conventional ink-jet recording unit in which a recording head is removed from an ink cartridge.
Figure 3A:
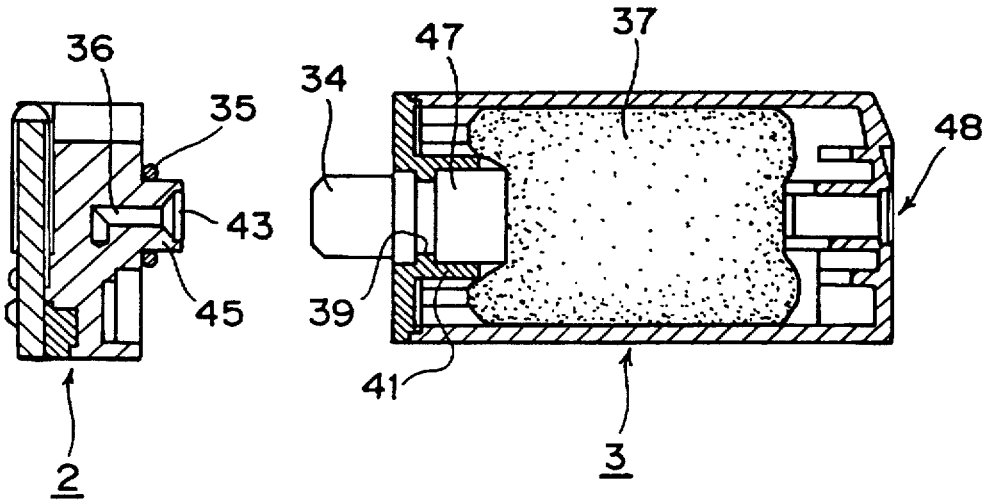
FIG. 3A is a cross sectional view of an ink-jet recording unit according to the first embodiment of the present invention in which a recording head is removed from an ink cartridge.
Figure 3B:
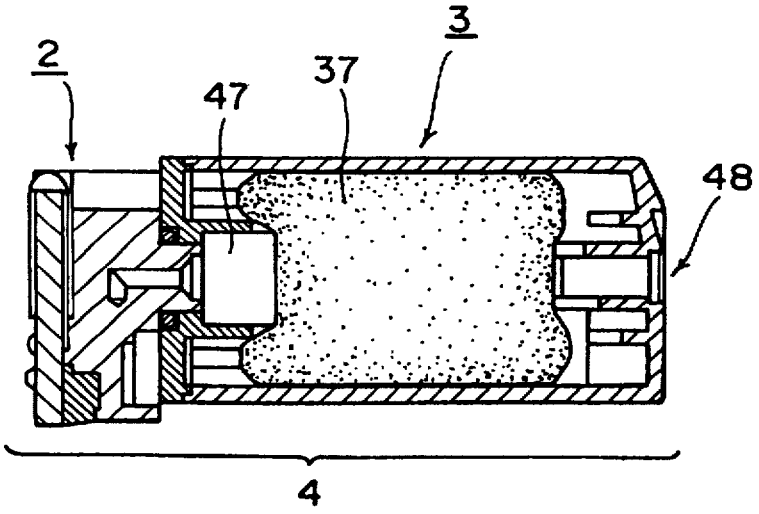
FIG. 3B is a cross sectional view of a conventional ink-jet recording unit according to the first embodiment of the present invention in which a recording head is removed from an ink cartridge.

FIGS. 3A and 3B show cross sectional views of an ink-jet recording unit 4 as a first embodiment of the present invention. The recording unit 4 is composed of two parts, a recording head 2 and an ink cartridge 3, which are easy to connect with each other as shown in FIG. 3B and also easy to take off from each other as shown in FIG. 3A.

The ink-jet recording head 2 has a filter 43 at an end of an ink-inlet portion 45 which functions as a connecting portion with the ink cartridge 3. The filter 43 has a plurality of pores that have a constant pore size and is responsible for trapping debris in an ink flow when the recording head is being connected with the ink cartridge 3. The pore size of the filter 43 is in the range as defined below. That is, the upper limit of the effective pore size is defined as a maximum effective diameter of the pore enough to prevent an inflow of the debris to the recording heads, which is depended on a size of the nozzles foxed at the other end of the liquid passage in the recording head 2. On the other hand, the lower limit of the effective pore size is depended on a pressure loss of the filter 43 at the maximum amount of the ink flow and is defined as a minimum effective diameter of the pore not enough to affect on a process of printing with ink. The pressure loss is depended on a diameter of the liquid passage (i.e. an ink path) in the ink inlet portion 45 where the filter 43 is provided, so that judging from our experiment, it would be better to fix the effective diameter of the empty pore of the filter in the rage of 5–20 μm.

The ink cartridge 3 has a porous member (an ink absorber) 37 as an ink reservoir for storing ink and an ink inducing element 47 composed of fiber member. Reference numeral 48 denotes an air-communicating port for communicating inside of the ink cartridge with atmospheric air, and reference numeral 39 denotes an ink supply portion for connecting with a ink inlet portion 45 of the recording head 2.

The ink inducing element can be used for inducing ink in one direction in an apparatus. In this embodiment the ink inducing element is appropriately arranged in the ink cartridge so that ink is induced from the ink absorber to the ink supply portion. In this embodiment, the porous member 37 is an ink absorber such as a sponge being compressed in the ink-reserving portion of the cartridge.

The figures, the ink inducing member 47 is held by the support portion 41 of the cartridge, and an inner side of the ink inducing element 47 presses the ink absorber 37 so as to be deformed. Such deformation of the ink absorber 37 permits higher capillary action at the contacted point, by which the ink is centered at the neighborhood of the ink-inducing element.

Therefore, the air cannot be introduced into the ink-inducing element 47 because the ink-inducing element is able to hold the ink constantly supplied from the ink absorber whenever the recording head is detached from the ink cartridge and also meniscus can be formed on a surface of the ink-inducing element, which end faces the ink inlet portion 45 of the recording head.

An efficiency of using the ink stored in the ink cartridge can be improved by enhancing flow of the ink into the ink-inducing element and keeping the flow of the ink without break when an ink route is formed by attaching the ink-jet recording head 2 to the ink cartridge 3.

In the case of that the ink absorber 37 is being compressed in the ink cartridge 3 as that or the present embodiment, the ink-inducing element 47 pushes the ink absorber 37 to distort the compressed portion and its neighborhood of the ink absorber 37. Consequently, the ink can be centered at the neighborhood of the ink-inducing element 47.

In the case of using the low compressibility or elastic modulus or the ink absorber in the ink cartridge, it is preferable that the ink-inducing element is press-inserted to the ink absorber to distort substantially enough to concentrate the ink in the deformed portion.

In this embodiment, the term "press-inserted" means that the ink-inducing element is put into the ink absorber by applying force greater than that of the compression generally used.

In general, ink ejection ports of the recording head in the ink-jet recording apparatus is being kept at an appropriate water-head pressure so as to be lower than the atmospheric pressure to prevent deterioration of printing qualities to be caused by poor supply of ink to the ink ejection ports (i.e., nozzles) and also by the ink leakage therefrom. It is necessary to keep the pressure of ink in the recording head 2 at a lower water-head pressure compared with the atmospheric pressure (usually in the range of −150 mmAq to 0 mmAq or preferably in the range of −100 mmAq to −30 mmAq against the atmospheric pressure). In this embodiment, the porous member 37 is being kept at a pressure in the range of 40 mmAq–60 mmAq for regulating the condition of the ink so as to have a negative pressure.

The ink-jet recording head 2 is removably fixed with the ink cartridge 3 by means of a pair of connecting means 34 protruded from an end of the ink cartridge 3 to form parallel projections to be fitted into recesses (not shown) of the ink-jet recording apparatus A filter 43 of the ink-jet recording head 2 is compressed to the ink-inducing element 47 of the ink cartridge 3 by applying the forces each other at a predetermined compressive pressure.

The compressive pressure is easily depend on a length of projected part of the ink inlet portion 45 of the recording head 2 and a depth of the supply portion which is defined by a distance from an outer surface of the ink cartridge 3 to a contact face of the ink-inducing element 47 to be contacted with an end of the ink-inlet portion 45 of the recording head 2.

Accordingly, the connection makes an ink path 36 for supplying ink to an inlet of the recording head 2 through the ink inducing element 47.

According to the structure of the present embodiment, an ink leak and an ink evaporation from the contacted point can be kept to a minimum because the ink passage formed by the contact between the ink-inlet portion 45 and the ink supply portion 39 is sealed by an O-ring 35 fitted to a connected portion of the recording head 2.

Figure 4:
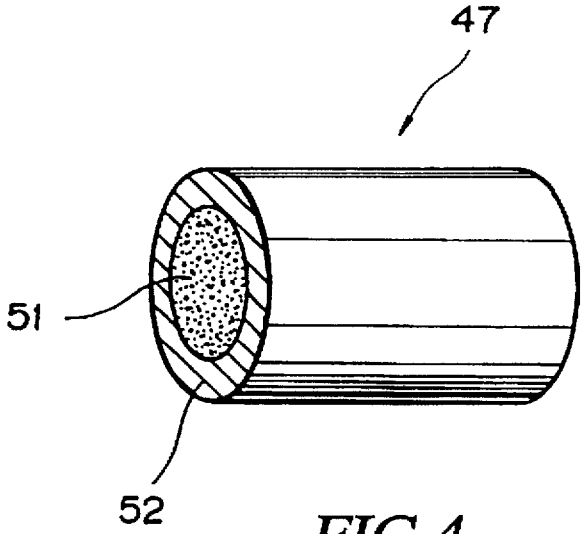
FIG. 4 is a perspective view of an ink-inducing element in accordance with the present invention.

FIG. 4 shows a structure of the ink-inducing element 47 as described above.

The ink-inducing element 47 is a bundle of fibers formed as an ink-supplying member for supplying the ink from the ink cartridge 3 to the recording head 2 when they are connected with each other and is composed of a plurality of the fibers which are arranged parallel to a direction of supplying the ink so as to supply the ink to one direction. The ink-inducing element 47 has a two regions in a diametrical direction (i.e., a direction perpendicular to the ink-supplying direction). That is, it has an outer peripheral region with a comparatively less ability of supplying the ink and an inner region with a comparatively excellent ability of inducing the ink. The outer peripheral region 52 is formed by applying a binder to fix the fibers so as to be closely packed, while the inner region 51 is formed so as to have a space between the fibers enough to pass the ink.

The term "a bundle of fibers" means a bundle of fibrous resin such as polyester, nylon, polypropylene, polyethylene, cellulose, and polyurethane, or a bundle of other fiberous materials such as metal, grass, and carbon, or a bundle of fiberous mixture of these resins and materials. Also, the phrase "fix the fibers so as to be closely packed" means that a space between the fibers is filled up with the binder or filler, or the fibers are fused with each other by heat or pressure.

The inner region may have different sized spaces as ink paths, so that it may include the different sized ink paths. That is, one type of the ink path has a diameter larger than that of the fiber, while other type of the ink path has a diameter smaller than that of the fiber. In this case, therefore, the ink can be uniformly supplied through a cross sectional area of the inner region in a direction perpendicular to the ink-inducing direction.

Preferably, each fiber is made of a material such as polyester, nylon, polypropylene, polyethylene, cellulose, and polyurethane, which are chemically stable materials to be easily wetted. One of the standards for evaluating the wetting property of the material is its ink-contact angle. That is, the material can be evaluated as a good one when the ink-contact angle is relatively small. It is also possible to use the material with a large ink-contact angle as an ink-inducing material by subjecting the material under hydrophilic processing. However, it cannot be recommended from the point of view of requiring additional steps, increasing cost of the product, and the like.

In addition, other materials such as metal, grass, carbon, and mixtures of at least two materials selected from the materials described above can be also used as fiber materials.

The ink-inducing element 47 should be arranged as a part of an ink path so as to feed the ink along the path, and it should be formed as one that has a constant physical strength enough to keep its form against the compressive pressure applied by the ink inlet of the recording head. Therefore, it is preferable to prepare the element as a bundle of the fibers.

An upper limit of a thickness of the fiber for the ink-inducing element is depended on a degree of contact between the ink-inducing element and the filter at the ink inlet portion described above. From this point of view, the fiber with a thickness of 0.05 mm or under is preferably used. In addition, it is preferable that a lower limit of a thickness of the fiber for the ink-inducing element is 0.01 mm or over for easily preparing a bundle of the fibers with low cost. In this embodiment, therefore, polyester fiber with a thickness of 0.03 mm is used.

In this embodiment, a resin binder is used as a means of fixing a bundle of the fibers. A peripheral surface and its neighborhood of the bundle are hardened by the binder to make a hardened region.

Polyurethane of polyestherpolyol is used as the resin binder to be penetrate the peripheral surface of the bundle but not limited to such substance, for embodiment, a melamine binder is allowed to be used when it is adapted to the object.

A means of forming the hard region 52 for fixing the bundle of fibers is not limited to the rein binder described above. The hard region 52 is also formed by fusing an outer peripheral region of the bundle by applying heat or pressure. In stead of the hard region, furthermore, it can be possible to cover the bundle or fibers with other material. Comparing two different means described above, the binder is more suitable than the cover means because of the following reasons. In the case of forming the hard region, a step of forming a bundle of fibers and a step of permeating the binder through the bundle can be performed almost at the same time. In the case of using the cover means, the process of fabricating the ink-inducing element can be complicated because a step of covering the bundle with the cover means should be performed in the condition of that the fibers are being bundled until it is covered evenly to make its physical strength uniform.

It is possible to use other methods of bundling the fibers it their products keep a direction of feeding the ink along the fibers and keep a form of the bundle of fibers to uniformly pass the ink through the bundle to constantly provide the ink.

Each fiber in the ink inducing element is aligned in a direction parallel to the ink flow in the element. A capillary pressure of the bundle to be formed is set up at a higher value compared with that of the porous member. In this case, the capillary force of the porous member includes one in case of that the porous member is compressed by the ink-inducing element.

Thereby, the ink rapidly reaches the tip of the ink-inducing element as a natural result when the, ink-inducing element 47 is pressed on the porous member 37 being soaked by the ink. The ink in the tip of the ink-inducing element does not leak out therefrom because a meniscus is formed by the capillary force of the bundle of fibers.

It is difficult to fix an extent of the hard region in a radial direction of the ink-inducing element because the hard region is formed by permeating the binder through the outer peripheral surface of the element. However, we defines a rough boundary line between the hard region and an inner region in which the binder is not permeated. Comparing the two regions, the ink passes through the inner region more smoothly than the hard region because gaps between the fibers of the hard region is filled with the resin or the like while the latter is not filled. The inner region includes large gaps with larger diameters compared with that of the fiber and small gaps with smaller diameters compared with that of the fiber. These gaps are mixed in the inner region to permeate the ink.

Figure 5:
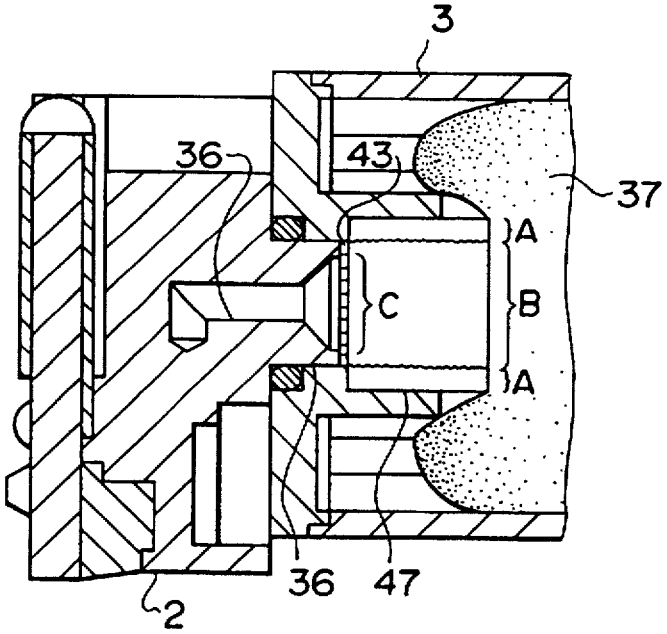
FIG. 5 is a grossly enlarged sectional view of a connected portion of the ink-jet recording head and the ink cartridge according to the first embodiment of the present invention.

FIG. 5 shows a connected portion between the ink-recording head 2 and the ink cartridge 3.

A contacting surface between the filter 43 of the ink-jet recording head and ink-inducing element 47 of the ink cartridge 3 is required to satisfy the condition of that a contacting area of the filter 43 is smaller than that of the ink-inducing element 47 as shown in FIG. 5. This condition of the contacting surface is determined for pressing a region C of the recording head 2 against the inner region B of the ink-inducing element 47. The region C is provided as an ink path in the recording head. According to such construction, it is possible to keep an uniform press-contacting condition at a region corresponding to an effective diameter of the filter.

As more preferable press-contacting condition to prevent the lowering of the amount of supplying ink, a whole area of an end of the ink inlet portion of the recording head should be contacted with the inner region B of the ink-inducing element to insure their contact.

From a practical point of view, the ink passes through the contacting face including a portion in which the ink inlet portion of the recording head is in contact with the hard region of the ink-inducing element. However, it is preferable that the contacting face C does not include such hand region because it will affect on the properties of performing high speed printing and the like.

In accordance with a degree of mechanical tolerance, assemble accuracy, or the like, the filter of the recording head may be unevenly pressed against the bundle of fibers. For supplying the ink to the recording head efficiently, however, the bundle of fibers and the filter should be press-touched uniformly against each other without forming wrinkles at their contacted ends. Therefore, the contact face between the filter and the ink-inducing element need their flexibility enough to compensate the mechanical tolerance, assembly accuracy, or the like to make the uniform contacted face. Viewed in this light, as compared with the hard region, it is preferable to press the filter against the inner region to make a stable supply of the ink.

As described above, the ink-inducing element 47 has the hard region with a thickness of about 1 mm in a radial direction, which is formed by permeating the binder through the outer peripheral surface of the element. In this embodiment, therefore, a touching position is fixed so as to separate an outer peripheral surface of the ink-inducing element 47 and an outer peripheral surface of the filter 43 at a distance (i.e., the amount or separation in a direction of the line normal to the outer peripheral surface of the filter in one plane) of 0.5 mm or over, preferably 1 mm or over to avoid a press-touched condition between the filter 43 and the hard region of the ink-inducing element 47. Judging from our experimental basis, however, it is possible to separate them at a distance of over 0.5 mm or under 1 mm without losing their functions but it causes an insufficient result in high-speed printing because of reducing the effective diameter of the filter.

According to the structure described above, the ink can be concentrated on the ink-supply portion of the ink cartridge in the case or being separated from the recording head so that the ink absorber adjacent to the ink supply portion is prevented from inducing air. Therefore, the ink can be smoothly supplied from the ink cartridge to the recording head when they are reconnected.

The ink absorber has a portion being deformed by applied pressure through the bundle of the fibers, and thus there is no need to insert the ink-inlet portion of the recording head to the ink absorber for deforming a part of the absorber to concentrate the ink thereon. Only the press-touched condition is required for the ink flow which flows from the ink inducing element to the ink inlet portion. Consequently, an influx of the air into the area around the ink-supply portion cannot be caused and this provides the recording unit with a suitable ink path from the ink cartridge to the recording head.

In the case that a relatively high speed printing is performed it is need for an ink supplying rate to be high while the ink cartridge 3 maintain a certain negative pressure. Therefore, it is preferably that ink flow resistance is as small as possible. The ink jet unit of the present invention answers this problem.

From the point of realizing both supplying the ink stably at the time of connecting with the recording head and preventing the ink leakage at the time of removing the recording head, in this embodiment, the ink-inducing element 47 is defined in detail as follows from the point of two different conditions, i.e., (i) a connected condition between the recording head and the ink cartridge, in which a sufficient amount of ink should be constantly supplied to the recording head; and (ii) a separated condition, in which an ink leakage from the removed ink-cartridge should be prevented. Therefore, properties of the ink-inducing element are discussed in detail in accordance with the conditions described above (Separated Condition)

In the case of removing the recording head from the ink cartridge, there is a possibility of subjecting an ink outlet side of the ink-inducing element directly to the external atmosphere. Therefore the ink cartridge should hold the ink without causing the ink leakage when its ink-outlet faces downward, or the like. In this embodiment, the ink-inducing element and the sponge (the ink absorber) are responsible for keeping the ink-holding force against the ink stored in the ink cartridge. That is, the ink-inducing element and the sponge have to generate a certain degree of negative pressure enough to hold the ink without causing the ink leakage from the ink supply portion of the ink cartridge by means of their capillary forces.

The capillary forces of the ink-inducing element and the sponge are defined in view of performing a constant supply of the ink as described below, considering an acceleration of the ink flow or the like to be effected by physical conditions of the ink such as mass of the ink and a degree of ink vibration during the movement of the ink cartridge. Therefore, the capillary force of the sponge should preferably be in the range of 40 mmAq or over, and thus in the present embodiment it takes 50 mmAq. On the other hand, the capillary force for the ink-inducing element should preferably be 1.5 times larger than that of the sponge and preferably in the range of 85 mmAq to 400 mmAq.

Regarding the movement of the ink cartridge, there is a possibility of causing the acceleration of the ink flow as mentioned above. Therefore the higher the capillary force of the ink cartridge is, the more the ink can be preferably held. If it is too high, however, a high suction pressure will be required in an ejection recovering operation for pulling the ink out from the ink cartridge. Accordingly, an upper limit of the capillary force of the ink cartridge should preferably be 400 mmAq or under. In the present embodiment, the ink-inducing is formed so as to have the capillary force of 200 mm.

Alternatively, the ink-inducing element is also defined as follows The fibers in the inner region of the ink-inducing element is arranged so as to leave a constant space between them and to have a constant ink-holding force as indicated by the following equation which is judged from our examinational results:

$$ha \approx 4.2/ds \ldots \quad (1)$$

wherein "ha" means a capillary force [mmAq] as the ink-holding force of the ink-inducing element; and "ds" means the average of each distance between one fiber to adjacent one in a direction parallel to a cross sectional plane of the ink guide member.

As described above, the capillary force of the sponge should preferably be 40 mmAq or over while the capillary force of the ink-inducing element "ha" should preferably be 200 mmAq or over because of smoothly supplying the ink from the sponge to the ink-inducing element. Consequently, a value of the "ds" is preferably under 0.05 mm in accordance with the equation (1).

On the other hand, the capillary force is preferably under 400 mmAq because of above-described reason. Therefore, the value of the "ds" is preferably over 0.01 mm.

A diameter $\phi d$ of each fiber of the ink-inducing element should be preferably in the range of 0.01 mm to 0.05 mm because if it is too small the bundle of the fibers are difficult to make without a high manufacturing cost, while if it is too large the fiber does not have its flexibility enough to contact with the filter of the recording head.

A density N of the fibers of the ink-inducing element should preferably in the range of 100 to 2,500[numbers/$mm^2$] according to the following equation:

$$ds = \sqrt{(1/N)} - d \quad (2)$$

wherein

"ds" means the average distance between the fibers as defined above; "N" means the density of the fibers [numbers/$mm^2$]; and "d"means a diameter of the fiber.

The distance between the fibers is an average distance between surfaces of the fibers. That is, the distance is measured by using a cross sectional view of the bundle of the fibers in a magnified picture and by the steps of sampling several fibers (i.e., 30 fibers in the present embodiment) and measuring each space between a peripheral surface of one fiber and a peripheral surface of next fiber.

The diameter of the fiber is obtained as an average diameter of the fibers which are obtained by using magnified pictures and by the steps of sampling several fibers, calculating a diameter of each fiber at different points, and averaging the obtained data of the calculation.

An axial length (i.e, generally corresponds to a length of each fiber) of the ink-inducing element should be preferably in the range of 2 mm to 6 mm. If the ink-inducing element is too short, the bundle of fibers can be difficult to make and some of fibers in the inner side of the bundle comes out. In the ink-inducing element is too long, on the other hand, it is difficult to obtain a sufficient ink flow at the connected condition between the recording head and the ink cartridge. (Connected State)

In the case that the recording head is connected with the ink cartridge, considering the ink supply from the cartridge to the head, a pressure loss $\Delta P_f$ of the ink flow at a point of the ink-inducing element at a maximum flow rate should preferably be 20 mmAq or under. This value corresponds to the maximum flow rate under the condition of that the recording head has at least 64 ejection ports. If the pressure loss $\Delta P_f$ takes a value higher than that value, printing qualities can be affected in accordance with a difference between the printing duties. The pressure loss $\Delta P_f$ of the whole system of the ink supply from the ink cartridge to the recording head takes a value of 100 mmAq or under.

On condition that the ink-inducing element is subjected under the pressure loss $\Delta P_f$ in the range described above, sizes of the ink-inducing element can be defined as follows.

Figure 6:
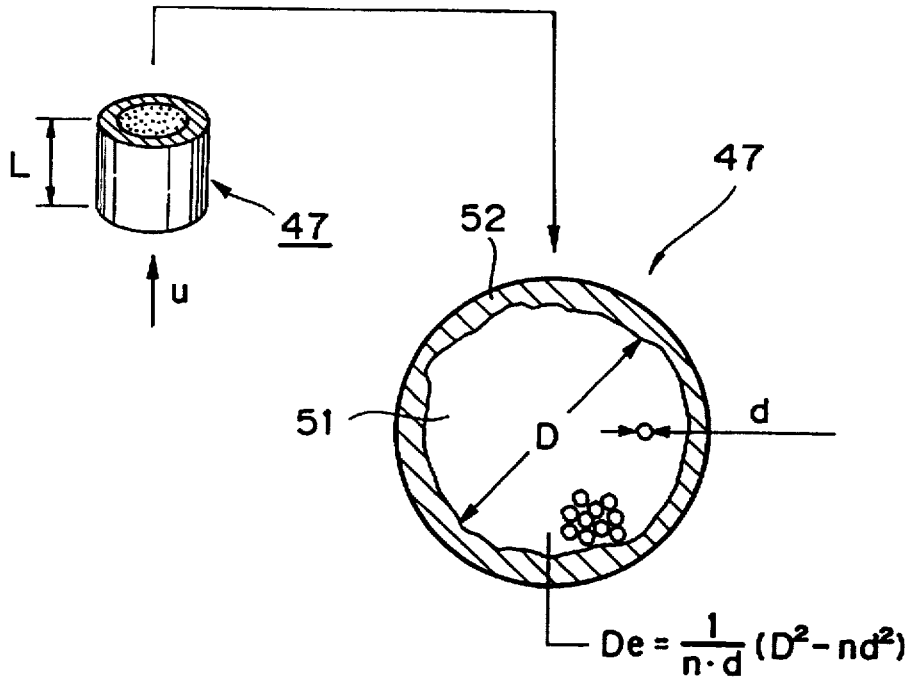
FIG. 6 is a detail view of the ink-inducing element of FIG. 4.
Figure 7A:
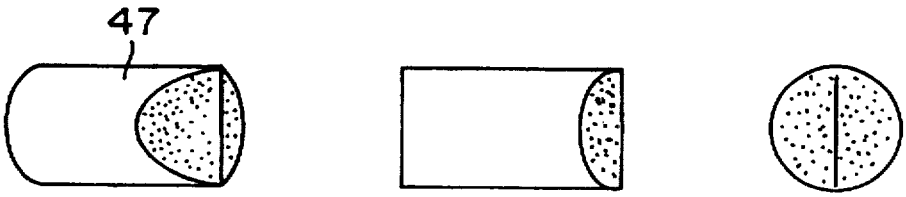
FIGS. 7A–7D are schematic representation of the modified embodiment of the ink-inducing element in accordance with the present invention.
Figure 7B:
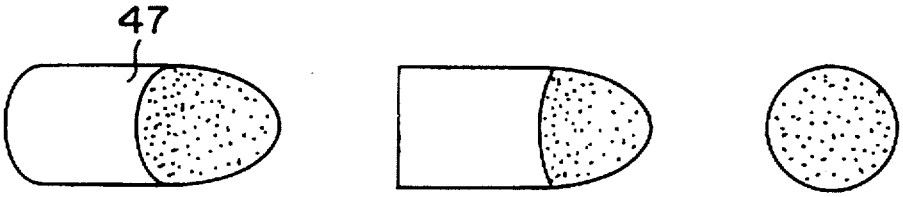
Figure 7C:
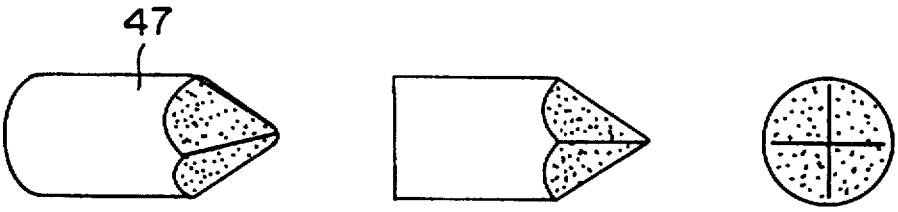
Figure 7D:
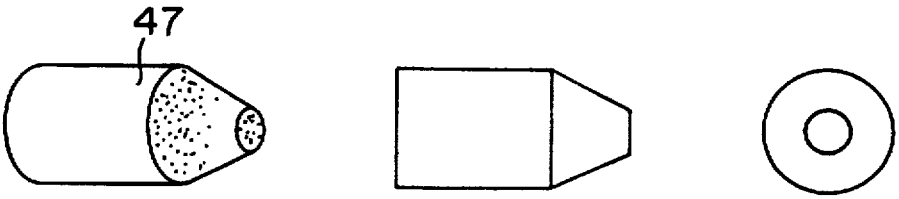

FIG. 6 is a schematic view showing sizes of the ink inducing element of the present embodiment.

A length "L" of the ink-inducing element 47 is taken as a size thereof in a direction parallel to the ink flow flowing at flow rate U [mm/sec]. An actual diameter De of the ink inducing element generally corresponds to a diameter of an ink path in the inducing element. Therefore the actual diameter De is expressed by the following equation:

$$De = \frac{1}{n \cdot d}\,(D^2 - nd^2) \tag{3}$$

wherein

"D" means an effective diameter [mm] of the ink path, which corresponds to a diameter of the inner region 51; "d" means an average diameter [mzm] of each of the fibers in the inner region 51; and "n" means the number of these fibers.

The length "L" and the diameter "De" described above can be also defined by the flowing equation using the pressure loss $\Delta P_f$ described above:

$$\Delta P_f = K \cdot u \cdot \frac{L}{De^2} \tag{4}$$

wherein u=W/S, in which "S" means a cross sectional area [$mm^2$] of the ink path and "W" means a flow amount rate [$mm^3$/second] of the ink flow; and "K" means a resistance coefficient [mmAq.sec] which takes a value of around $4.2\times10^{-3}$ (this value is judged from a result of our experiment) in case of the ink-inducing element having the structure described above.

In this embodiment, the cross sectional area "W" is in the range of 26 [$mm^3$/sec] to 512 [$mm^3$/sec] in accordance with the maximum and minimum quantities of the ink ejection by the serial head.

The length "L" can be fixed in accordance with the definition described above, or with the size of the ink cartridge or the &.nouns of the ink to be stored in the sponge. On the other hand, the diameter "De" can be fixed in accordance with the distance "ds" and the effective diameter "D". The effective diameter "D" should preferably be in the range of 1 mm to 18 mm in accordance with the pressure loss of the filter of the recording head and the ink flow amount rate W described above.

Accordingly, the ink-inducing element is able to take any structural dimensions with a limit of the definition described above. In general, however, any or the parts of a detailed plan for manufacturing the ink cartridge including its dimensions, volume and the like is determined prior to that of the ink-inducing element. Therefore, dimensions of the ink-inducing element should be formed so as to fit into a limited space in the ink cartridge and also so as to have required characteristics.

Table 1 below lists several embodiments of the design for the ink-inducing element under the following conditions. That is, dimensions of the ink-inducing element are 6 mm of the length L and 6 mm of an external diameter ϕD'; and 4.8 mm of an effective diameter ϕD without a thickness of the binder, while required properties of the ink guide element are 200 mmAq of the ink-holding force ha; and 10 mmAq or less of pressure loss $\Delta P_f$ at 42 mm/sec of flow rate W. In addition, the distance "ds" between the fibers is 0.021 from the "ha" in accordance with the definition described above.

TABLE 1

| | ϕd | N | n | De | S | u | $\Delta P_f$ | Decision |
|---|---|---|---|---|---|---|---|---|
| (1) | 0.01 | 1041 | 18830 | 0.11 | 16.6 | 2.5 | 5.0 | favorable Large n |
| (2) | 0.02 | 595 | 10764 | 0.087 | 14.7 | 2.9 | 9.5 | optimum |
| (3) | 0.03 | 385 | 6757 | 0.080 | 13.2 | 3.2 | 12.4 | unfit $\Delta P_f > 10$ |
| (4) | 0.04 | 269 | 4863 | 0.078 | 12.0 | 3.5 | 14.4 | unfit $\Delta P_f > 10$ |
| (5) | 0.05 | 198 | 3590 | 0.078 | 11.0 | 3.8 | 15.6 | unfit $\Delta P_f > 10$ |

According to the results listed in the Table 1, when the ink-inducing element is formed by the designs (1) and (2), the resulting ink-inducing element will be fit to the conditions described above. The pressure loss $\Delta P_f$ of the design (1) is lower than that of the design (2), it is however preferable to use the design (2) from the point of saving the cost of product because the member according to the design (2) has a small namer of the fibers. The designs (3)–(5) are not preferable to produce the ink-inducing element because the pressure loss $\Delta P_f$ at the maximum flow rate of the ink is higher than 10 mmAq which is a value of the upper limit of required condition described above. As explained above, the dimensions of the ink-inducing element should be defined as described above to obtain the properties or avoiding the ink leakage during the separated condition and supplying the ink smoothly from the ink cartridge to the recording head during the connected condition. It may be worth pointing out that these properties cannot be obtained by just using the known material with an ability of absorbing the ink by its capillary force After inserting the ink-inlet portion of the recording head into the ink supply portion of the ink cartridge, the important point to be noted is that a space between the ink supply portion and the press-touched point should be filled up with the ink and also the ink path should be isolated from the external atmosphere. In this case, an elastic member such as an O-ring can be generally used For making the connected portion airtight. However, the air easily gets into a part of the ink path during the period of the connection because the ink-inlet portion pushes the air into the inner side of the ink cartridge. Consequently, in a conventional structure, it causes air bubbles in press-touched region of the sponge and the fluid resistance is much increased, resulting that the recording head cannot obtain the sufficient amount of the ink.

One of the conventional means for solving such problem is, for embodiment a valve mechanism which is responsible for closing the ink path when the recording head is removed. In general, the valve mechanism is saturated with ink to avoid the generation of air bubbles during the period of reconnecting the recording head with the ink cartridge. On the other hand, the ink-inducing element of the present invention does not cause the problem described above.

The ink-inducing element is not limited to a columned shape, but also it is possible to have different shapes, for embodiment as shown in FIGS. 7A–7D.

Each ink-inducing element illustrated in FIGS. 7A–7D is formed so as to have its own shape which is appropriate to introduce the ink from the sponge with comparatively small resistance because, as shown in the figures, a sponge-side end of the ink-inducing element has the inner region having a larger surface area compared with that of the columned shape member. Therefore the ink-inducing element with the modified shape can be press-touched with the sponge 37, extensively.

It is necessary, at this point, to explain the fluid resistance of the ink cartridge in connection with the structure thereof.

In the case of performing the high-speed printing, the ink-jet recording head 2 must eject a lot of ink droplets per unit time while the ink cartridge must keep its negative pressure at a constant value to meet a demand of the head 302. Therefore a flow resistance in the ink path should be lowered to the utmost.

Figure 8A:
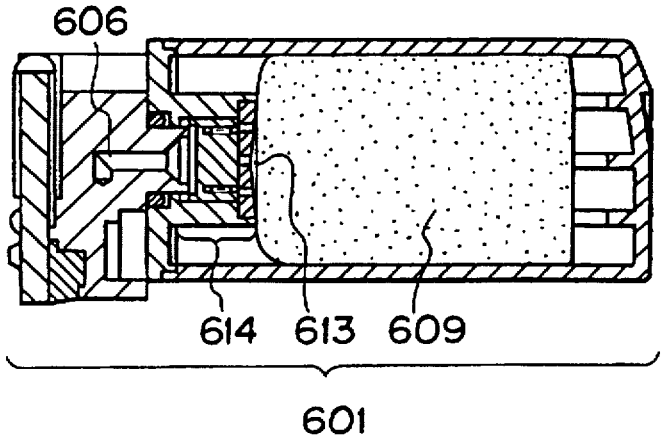
FIG.8A PRIOR ART
FIG. 8A is a cross sectional view of an ink-jet recording unit having a valve mechanism in which a recording head is connected with an ink cartridge.
Figure 8B:
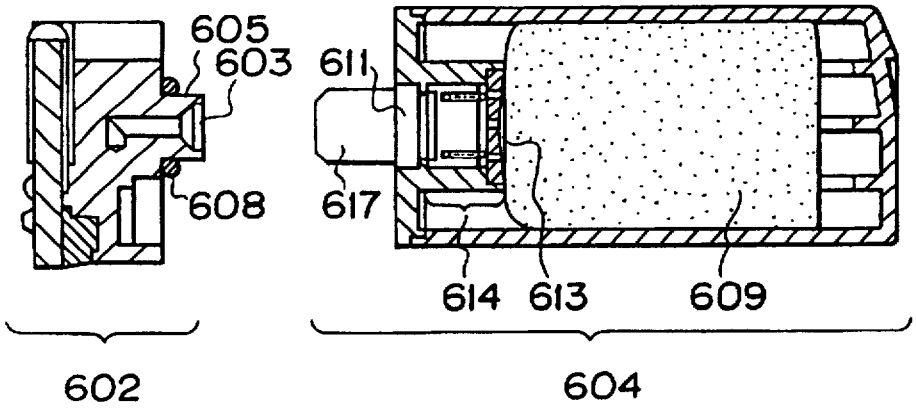
FIG.8B PRIOR ART
FIG. 8B is a cross sectional view of an ink-jet recording unit having a valve mechanism in which a recording head is removed from an ink cartridge.

FIGS. 8A and 8B show a cross-sectional view of a conventional recording unit as a comparative embodiment of the present invention, in which an ink cartridge 604 has a valve mechanism 614 is provided at a portion to be connected with a recording head 602. In these figures, FIG. 8B shows that the recording head 602 is separated from the ink cartridge 604 while FIG. 8A shows that they are connected reversibly by two hooked plates 617 which are parallelly projected from an end of the ink cartridge 604 to hold the recording head 602 by inserting them into connecting holes (not shown) formed in the recording head 602

The recording head 602 has an ink inlet portion 605 to be inserted in an ink supply portion 611 of the ink cartridge 604 and a filter 603 provided at an end of the ink inlet portion 605 for preventing an inflow of debris. As shown in figures, an O-ring 608 is coaxially placed around the ink inlet portion 605. The O-ring 608 is responsible for sealing the ink path from the outside.

The ink cartridge 604 includes an ink absorber 609 which is able to hold the ink therein. The density of the ink absorber 609 can be adjusted to obtain a negative pressure for the ink-supply for the ink-jet recording head 602.

A mesh filter 613 is provided on the ink-supply port side of the ink path and presses the ink absorber 609 to make a compressed portion with a high density in the absorber 609. Therefore, the compressed portion keeps its equilibrium to smoothly guide the ink from the ink absorber to the recording head.

By means of the valve mechanism 614 that acts on the downstream of filter 613 in the cartridge 604, ink does not leak out from the ink cartridge 604 when the ink cartridge is separated from the recording head 602.

Figure 9A:
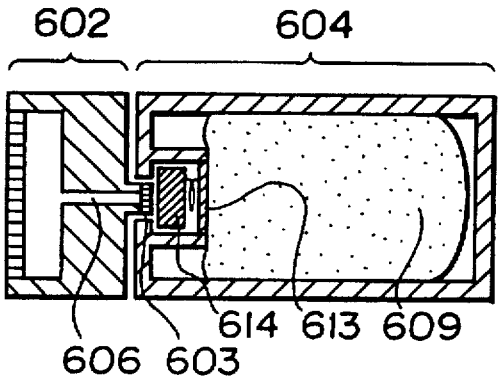
FIG.9A PRIOR ART
FIG. 9A is a cross sectional view of the ink-jet recording unit having the valve mechanism as shown in FIGS. 8A–8B, in which a recording head is connected with an ink cartridge.
Figure 9B:
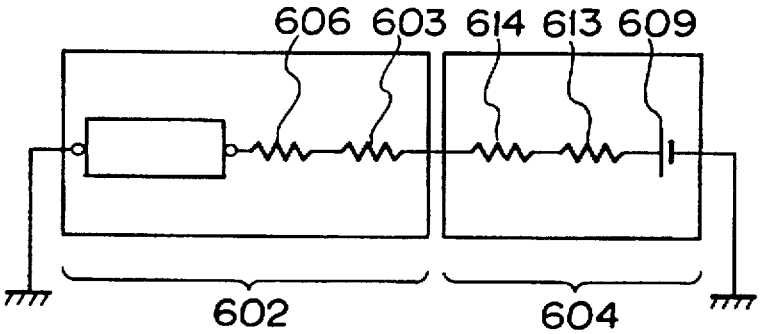
FIG.9B PRIOR ART
FIG. 9B is a circuit diagram for explaining a fluid resistance concerned with the ink-jet recording unit having the valve mechanism as shown in FIG. 9A.

FIG. 9A shows an ink circuit from the ink cartridge 604 having the valve mechanism as shown in FIGS. 8A and 8B to the recording head 602; and FIG. 9B an equivalent electricircuit corresponding to the ink circuit.

In these figures, the ink-jet recording head is regarded as a load, the negative pressure of the ink is regarded as a voltage, the ink flow rate is regarded as a current, the ink flow resistance is regarded as a wiring resistance, and the flow resistance in the ink cartridge 604 is regarded as an internal resistance. Therefore, the flow resistance should be lowered in order to supply a large amount of the ink to the ink-jet recording head 602.

Figure 10B:
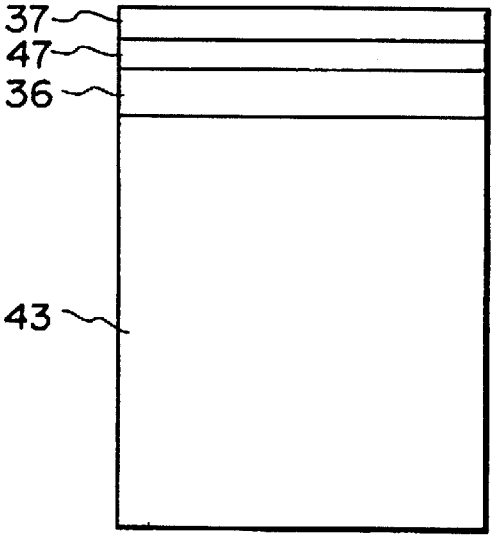
FIGS. 10B is a diagram of explaining a fluid resistance concerned with the ink-jet recording unit having the ink-inducing element in accordance with the present invention.
Figure 10A:
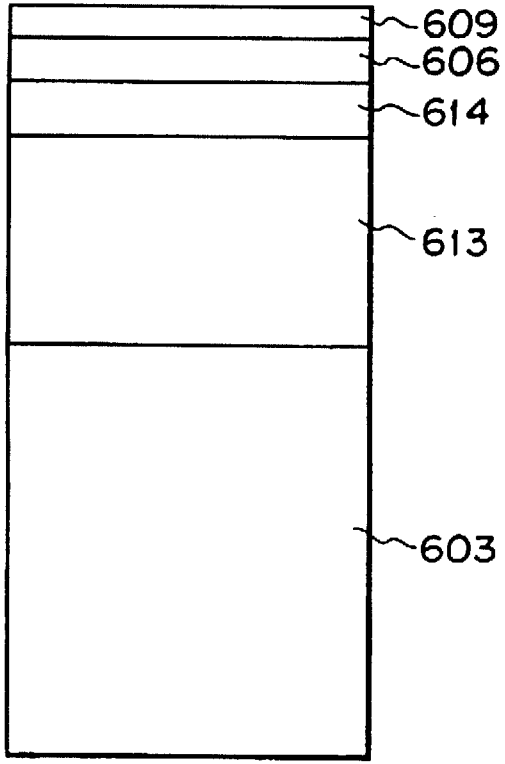
FIG. 10A PRIOR ART
FIG. 10A is a diagram of explaining a fluid resistance concerned with the ink-jet recording unit having the valve mechanism as shown in FIGS. 9A and 9B.

FIG. 10A shows the proportion of each part of the flow resistance of the ink-jet recording head 602 and the ink cartridge 604 that has the valve mechanism as shown in FIGS. 8A and 8B of the comparative embodiment. Each reference numeral corresponds with that of FIGS. 8A and 8E.

FIG. 10B shows the proportion of each part of the flow resistance of the ink cartridge 3 of the present embodiment. The ink cartridge 3 of the present embodiment does not have the filter 613 and the valve mechanism 614 as that of the comparative embodiment. In addition, the flow resistance of the ink-inducing element 47 takes a comparatively low value, so that the recording head 2 will be able to receive appropriate amount of the ink constantly during the period of high-speed printing. Each reference numeral corresponds with that of FIG. 3.

Figure 11A:
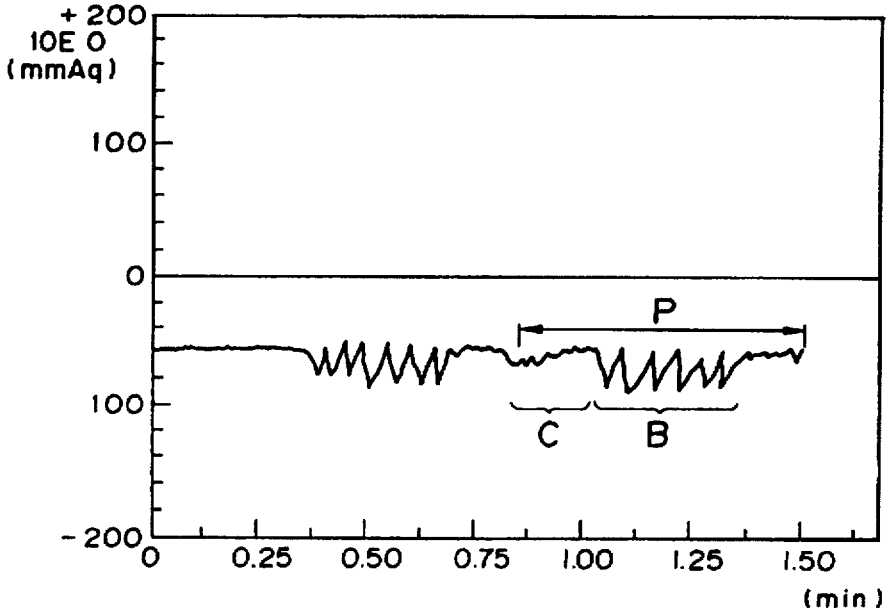
FIGS. 11A is a graphical representation of explaining an ability of supplying ink of the ink-jet recording unit having the valve mechanism.
Figure 11B:
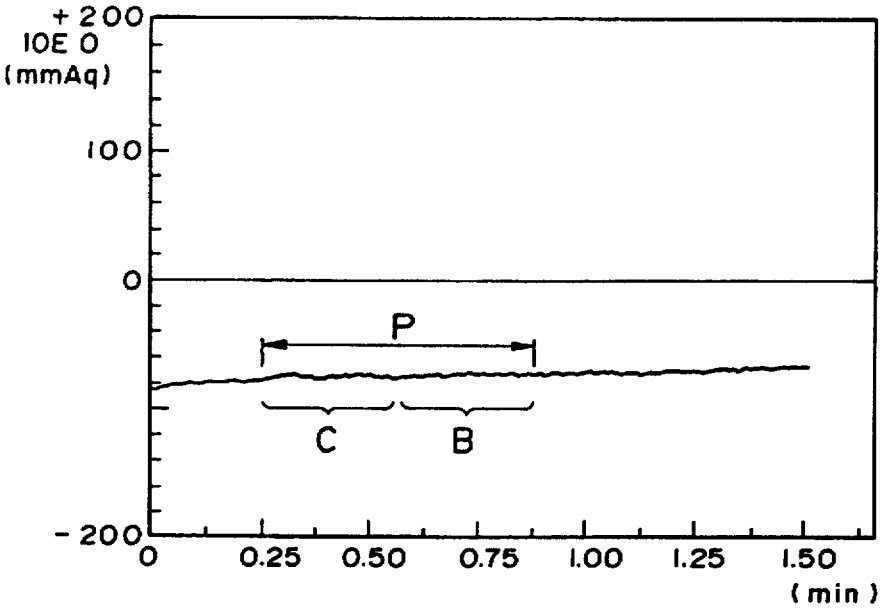
FIGS. 11B is a graphical representation of explaining an ability or supplying ink of the ink-jet recording unit having the ink-inducing element in accordance with the present invention.

FIGS. 11A and 11B show a variation of the ability of supplying ink to the recording head in case of using the valve mechanism of the comparative example (FIG. 11A) or in case of using the ink-inducing element of the present example (FIG. 11B).

In these figures, a letter "P" represents an image of printed pattern including line and solid regions. Also, a letter "C" represents the line region of the image while a letter "B" represents the sold region thereof.

During the period of resting the printing procedure, a pressure in the ink path is kept almost in the range of −60 mmAq to −80 mmAq against that of the external atmosphere by a capillary force which is responsible for keeping the ink in the ink absorber.

According to the results of the measurement in the resting state, the ink cartridge having the valve mechanism is at a pressure of about −60 mmAq (FIG. 11A), while the ink cartridge having the ink-inducing element is at a pressure of about −80 mmAq (FIG. 11B) against the atmospheric pressure.

During the period of printing a printing pattern including a portion which requires a lot of amount of the ink (i.e., solid portion), a pressure loss, which is due to the fluid resistance, is observed in the ink cartridge having the valve mechanism as shown in FIG. 11A. On the other hand, the ink cartridge according to the present invention does not cause such troubles, i.e., the amount of the pressure loss is extremely low and thus it is suitable for a high-speed printing and the like.

Furthermore, it is noted that the ink cartridge according to the present example is able to keep its excellent reliability in spite of after resting for a long time. In general problems of the conventional ink-jet recording apparatus, air bubbles are easily generated in the ink path of the ink-jet recording unit after resting for a long time and these air bubbles are responsible for unsatisfactory results in printing. That is, the air bubbles may block the ink flow to the recording head, and resulting that the recording head cannot perform the printing after the long rest. If a few air bubble, in general they are filled with saturated vapor, are introduced into the ink path during the period of resting state, a volume of the air bubble becomes increased because the air permeates into the ink path through the wall to dilute the amount of the vapor by an osmotic action of the external atmosphere. For solving the above problems, it has been Proposed that timer for counting a period of post-resting time is mounted on the ink-jet recording head and counting the time. If the operation time passes longer than the period described above the pumping will be started to remove the air bubbles with the ink.

However, occasionally a size of the air bubbles become glowing within the period described above under a bad environmental condition such as under both an extremely high temperature and a low relative humidity, and these grown air bubbles interrupt the ink flow to the recording head to cause its poor printing abilities. Especially in case off that the valve mechanism 614 is driven at the time of connecting or separating the ink-jet recording head 602 and the ink cartridge 601 as shown in FIG. 8A, the air from the outside may be introduced into a certain region of the ink path, which corresponds to an extent or the valve movement or the like. Therefore, the valve mechanism makes an unfavorable condition under the environment described above.

According to the present invention, on the other hand, the ink cartridge has the ink-inducing element with an area where the ink contacts. Therefore a meniscus can be formed all over the ink-contacting area and it is responsible for preventing an influx of the air bubbles at the time of separating the recording head and the ink cartridge. According to the present invention, furthermore, the filter of the recording head is press-touched directly with the ink-inducing element, so that a possible area of permitting the air permeation is decreased compared with that of the valve mechanism. Consequently, the ink cartridge of the present invention makes it possible to remove the air at the connection to prevent the presence of the air in the connected portion or in the ink path.

<Embodiment 2>

Figure 12:
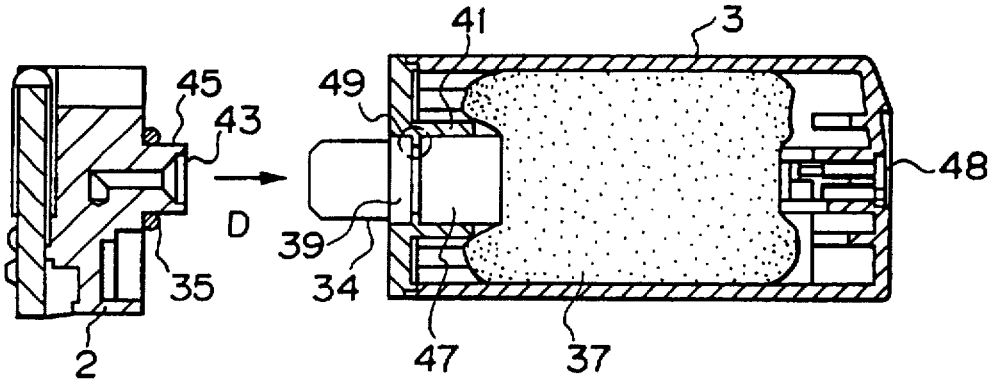
FIG. 12 is a cross sectional view of an ink-jet recording unit according to the present invention, in which a recording head is separated from an ink cartridge.

FIG. 12 is a cross sectional view of a second embodiment of the recording unit in accordance with the present invention. In this embodiment, an ink-inducing element 47 is Provided by the same way as that of Embodiment 1, except that the element 47 i s able to slide in a holder portion 41 to contact with the filter 43 of the recording head 2 in a direction of a pointing arrow D. The ink-inducing element 47 is pressed against the ink absorber 37 being compressed in the ink chamber and thus the element 47 receives the reactive force directing to the ink supply portion 39. As shown in the figure, however, an edge of the ink-inducing element 47 stops against a stopper 49.

In the case of inserting the ink-inlet portion 45 of the recording head 2 into the ink-supply portion 39 of the ink cartridge 3, the ink-inlet portion 45 touches the ink-inducing element 47. In the case of Embodiment 1, magnitude of the force of pressing the ink-inlet portion against the ink-inducing element is depended on relationship between them. In the case of Embodiment 2 in which the ink-inducing element is provided as a slidable one, on the other hand, the magnitude of the force is depended on a state of pressing the ink-inlet portion into the ink absorber and a slide distance of the ink-inducing element by inserting the ink-inlet portion.

Taking the structure described above, the filter and the ink-inducing element are stably press-touched to each other in case that the ink-inducing element is designed and finished comparatively with wrong dimensions in a longitudinal structure because these dimensional errors can be compensated by sliding the ink-inducing element.

When the ink-inducing element 47 is fixed without causing any sliding movement, therefore, there is a possibility that an ink flow along the ink path will be interrupted by gaps between the ink-inlet portion and the ink-inducing element, which formed by the imperfect connection therebetween due to structural troubles of the ink-inducing element, such as an uneven surface of end and a short length thereof in accordance with its poor processing accuracy. In the case that the ink-inducing element is farmed as too long, on the other hand, over-pressure of the ink inlet portion against the ink inducing element occurs so that the fiber in the ink inducing element is deformed and forming local area through which ink cannot flow. As a result, there is a possibility that the recording head will get an insufficient or inconstant supply of ink.

According to the sliding mechanism of the ink-inducing element, therefore, it is possible to make a stable press-touched condition and also to prevent an influx of the air during the period of the connection in the case ol fastening and unfastening the ink cartridge to the recording head over and over again. Furthermore, cost of the product can be decreased because these dimensional errors can be compensated by sliding the ink-inducing element and thus there is no need to make the ink-inducing element precisely.

The ink-inducing element should be arranged so as to slide at least 0.1 mm or over (i.e., a lower limit of the slide distance) because the filter can be placed in contact with the ink-inducing element by changing the shape of the contacted face of the latter by changing the magnitude of the pressure to be applied thereon.

However, the elastic deformation causes some troubles. When the filter is being pressed against the ink-inducing element for a long time (i.e, several months or several years), the contractive surface of the ink-inducing element to the filter may be gradually crept(i.e., plastic deformation) and force that tends to push the filter apart (i.e., repulsive force) may be gradually reduced. Consequently, the filter and the ink-inducing element do not exert forces uniformly against each other and their contractive faces become poor, so that the air can be introduced into the ink path and interrupts the irk flow to the recording head. As a result, the ink-ejecting condition of the recording head becomes poor.

For solving the creeping phenomenon described above, the ink-inducing element is slideably supported in the ink cartridge and is pressed against the filter by receiving force as the repulsion from the sponge in the ink cartridge.

Therefore, the ink-inducing element should have a slidable distance of at least 0.1 mm or over in the ink cartridge for obtaining the required pressure of 5 g/mm$^2$ (an experimental value) on the press-touched point. In is noted that the slidable distance of at least 0.1 mm or over is a preferable condition from the point of making the correction for an error in measurement in manufacturing the ink cartridge or the ink-inducing element.

An upper limit of the slidable distance of the ink-inducing member is 3 mm or under, preferably 2 mm or under, and more preferably 1 mm or under. In addition, the ink absorber has its own elastic modulus different from that of the ink-inducing member but it is also elastically deformed. Therefore, an upper limit of the slidable distance of the ink absorber is 3 mm or under, preferably 2 mm or under, and more preferably 1 mm or under from the point of preventing the creep phenomenon in which force that tends to push the ink-inducing element apart is gradually reduced in the same manner as that of the ink inducing member.

In the case of using another type or the ink-absorber characterized by its low degree of compression and its low elastic modulus, the ink-inducing element is press-inserted into the ink absorber in general, in this case a lower limit of its slidable distance is also determined in accordance with a degree of the force to be applied from the ink-inducing member to the ink absorber.

The term "press-insert" can be defined as applying force greater than that of the press-touched condition in which the ink-inducing element is pressed against the ink absorber. That is, the ink-inducing element is push into the ink absorber to make a tight contact therebetween.

As described above, the filter of the ink-inlet portion of the recording head and the ink-inducing element of slidable type can be more perfectly contacted with each other compared with the fixed type because the ink-inducing is able to slide along a direction of inserting the ink-inlet portion into the ink cartridge to preferably fit to each other. Consequently, the ink path can be formed more perfectly from the ink cartridge to the recording head and thus it is difficult to get the air into the ink path and the amount of the ink supply cannot be reduced. Accordingly, high qualities of the printing can be achieved.

For making an appropriate contact between the filter of the recording head and the ink-inducing element, it is preferable that the ink-inducing element has a certain degree of elastic strain, that is a reversible dimensional response to stress corresponding to a force for moving a bar (1 $mm^2$ in an area of cross section) 1 mm in reverse direction, which is in the range of 100 $gf/mm^3$ to 500 $gf/mm^3$.

In addition, it is noted that the ink cartridge of the present embodiment further produces satisfactory results in the ink supply after the reconnection with the recording head because of its structure. That is, the ink-inducing element is in the state of press-touching with the sponge at all times to satisfy the requirement of that an ink-outlet area of the sponge in the ink cartridge must be in the state of being pressed by something at all times in the case of removing the recording head. On the other hand, the recording unit having the structure of compressing the sponge of the ink cartridge directly by the recording head cannot maintain the compressive force against the sponge in the removed condition and the air can be introduced into the sponge all the time of reconnecting the recording head with the ink cartridge.

According to the structure of the ink cartridge of the present embodiment, as shown in FIG. 12, the sponge is compressed and supported in the ink cartridge by the inner wall thereof. However, an ink-outlet side of the sponge is press-touched by the ink-inducing element with a higher compressive force compared by that of the inner wall. The press-touched point is a most deformed portion of the sponge and thus the ink in the sponge tends to concentrate on the press-touched point.

In the case of using the sponge with comparatively lower degree of the compressive state in the cartridge, or with comparatively lower elastic modulus, it is preferable to press insert the ink-inducing element into the sponge for making sure the deformation mentioned above so as to concentrate the ink on the press-inserted point.

The term "press-inert" can be defined as applying force greater than that of the press touched condition.

Figure 13A:
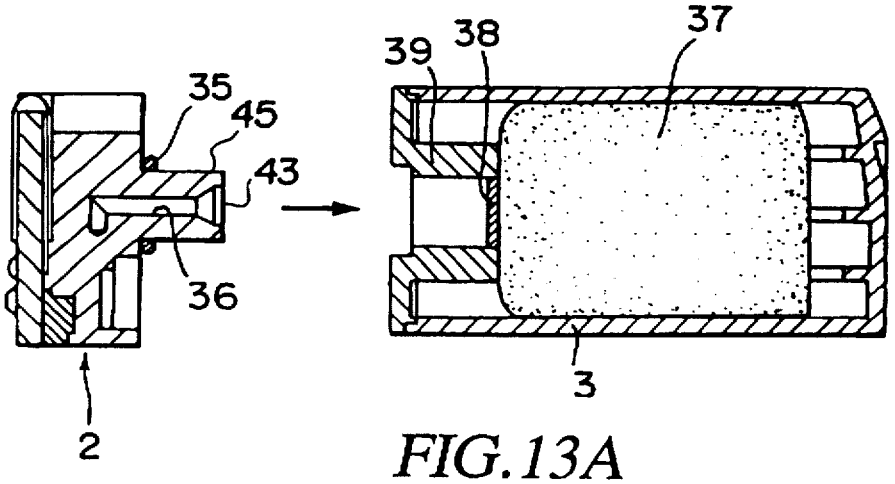
FIG. 13A is a cross sectional view of an ink-jet recording unit using a filter instead of the ink-inducing element, in which a recording head is connected with an ink cartridge.
Figure 13B:
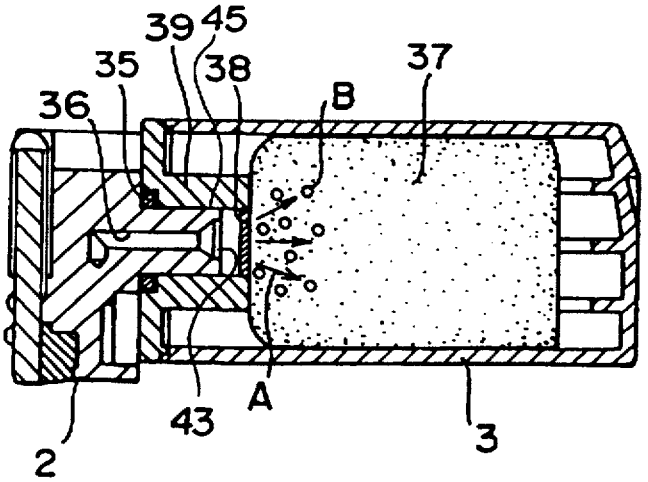
FIG. 13B is a cross sectional view of an ink-jet recording unit using a filter instead of the ink-inducing element, in which a recording head is removed from an ink cartridge.

As the substitute of the ink-inducing element, by the way, it is possible to take the structure as shown in FIG. 13 in which a filter 38 is press-touched with the ink absorber 37.

More specifically, the inventors of the present invention design not only the aforementioned structure in which the ink held in the ink absorber is centered on the ink supply portion side, but also the structure shown in FIG. 13. In this structure, a filter 38 on the connecting portion (the ink supply portion) 39 is press-fitted to the ink absorber 37 so that ink is always centered on the ink supply portion 39 side.

The inventors have understood that the ink jet unit with this structure, however, has following problems through an experiment.

As shown in FIG. 13, the ink path 36 is isolated from the external atmosphere by sealing the connected portion by means of the O-ring 35 during the period of connecting the recording head 2 with the ink cartridge 3. At the time of inserting the ink-inlet portion 45 into the ink-supply portion 39, the O-ring presses the air in an inner portion to be formed as a part of the ink path 36 toward the mesh filter 38. Therefore, the air moves to the mesh filter 38 and then gets into the mesh filter 38. In the mesh filter 38, the air remains as air bubbles and interrupts the ink path or dispersed into the sponge 37 (in the figure, indicated by arrows and a letter A). As a result, the ink is poorly supplied from the ink cartridge 3 to the recording head 2 and deteriorate the printing qualities.

This kind of problems can be effectively solved by using the ink-inducing element of the present invention. That is, the ink-inducing element stops the movement of the air to be Pressed into the ink absorber side in the ink cartridge by the comparatively strong capillary force of the ink-inducing element.

However, it is preferable to form the ink cartridge as described below For more perfectly stopping the influx of the air.

<Embodiment 3>

Figure 14A:
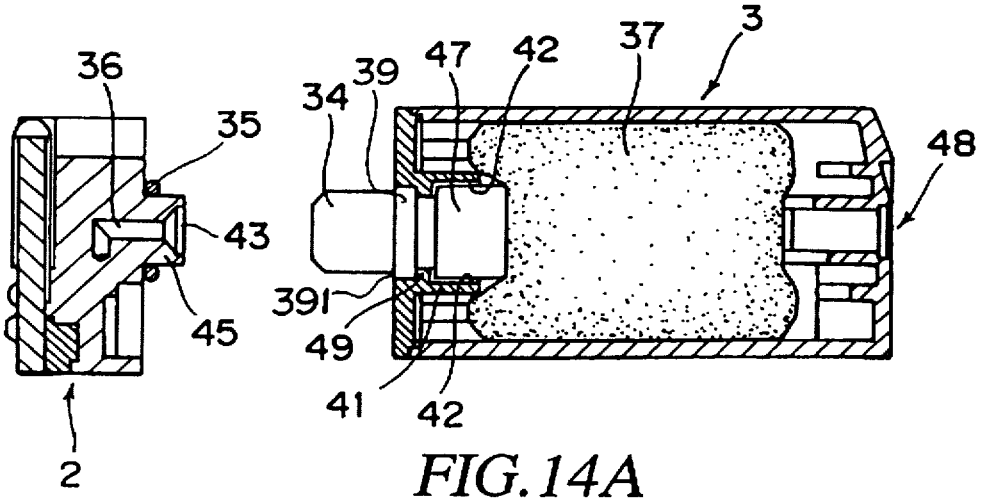
FIG. 14A is a cross-sectional view of an ink-jet recording unit according to the third embodiment of the present invention, in which a recording head is removed from an ink cartridge.
Figure 14B:
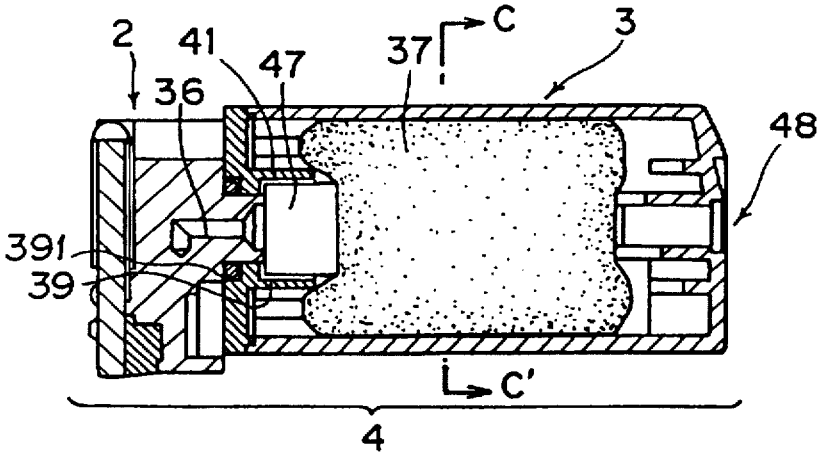
FIG. 14B is a cross-sectional view of the ink-jet recording unit, in which a recording head is connected with an ink cartridge.
Figure 14C:
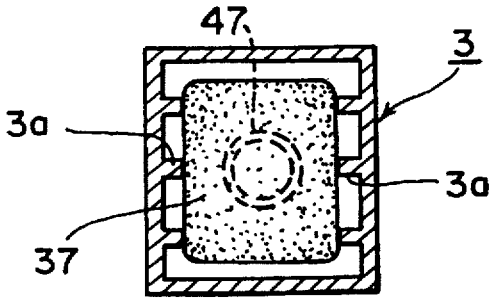
FIG. 14C is a fragmentary view taken in the direction along line C–C' of FIG. 14B.

An ink-jet recording unit of the present embodiment according the present invention will be explained in detail with reference to FIGS. 14A–14C.

The ink-jet recording unit of the present embodiment is the same one as described of Embodiment 1 or 2, except that an air-communicating path is formed in the ink jet cartridge so as to prevent a formation of the air layer described above more perfectly FIGS. 14A–14C are cross-sectional views of the ink-jet recording unit, wherein FIG. 14A shows that a recording head 2 is removed from an ink cartridge 3; FIG. 14B shows that they are connected with each other; and FIG. 14C is a fragmentary view taken in the direction along line C–C' of FIG. 14B.

The ink-inducing element 47 is placed between an opening (i.e., an ink-outlet) 391 formed on a front side of the ink cartridge 3 and a sponge (i.e., a porous member) 37 equipped in an inner side of the ink cartridge 3. The ink-inducing element 47 is supported by a support region 41 which is a sponge side part or an inner peripheral surface of the ink-supply portion 39. As shown in the figure, about over half part or the ink-inducing element 47 is supported by the supporting region 41 at a peripheral surface of the element 47 along an axial direction thereof.

On the other hand, a remained part of the peripheral surface is exposed to the air in the ink cartridge 3. That is, only one end of the ink-inducing element 47 is contacted with the sponge 37 while other end thereof is a free end exposed to the external atmosphere through the ink-outlet 39 of the ink cartridge 3. In addition, an edge of the free end of the ink-inducing element 47 is supported by a supporting plate 49 which stands on the inner peripheral surface of a boundary between the supporting region 49 and the ink outlet 391 and stands out in a diametrical direction, and thus the ink-inducing element 47 cannot protrude from the ink outlet.

In inner peripheral surface of the support region 41 grooves 42 are formed along an ink supply direction. These grooves 42 are provided as air communicating paths between the ink-inducing element 47 and the support region 41. In addition, an inner side of the ink cartridge has a plurality of projections (ribs) **3*a* being elongated along an ink supply direction. Therefore, the sponge 37 is supported by these ribs 3*a*, so that space between the sponge 37 and an inner wall of the ink cartridge 3 is formed so as to communicate with the grooves 42**.

Furthermore, an air-communicating port 48 is formed in a back side wall of the ink cartridge 3, through which the air paths 42 and the space described above is communicated with the external atmosphere.

Therefore, during the period of connecting the recording head 2 and the ink cartridge 3, in the case that the ink-inlet portion of the recording head 2 is pressed against the ink-inducing element 47, the air in space between the ink-inducing element 47 and the connected point is pressed toward the ink-inducing element 47.

In this case, however, the air can be escaped to the out side of the ink cartridge 3 by passing through the air communicating path formed by the grooves 42, the space described above, and the air communicating port 48. Also, it is noted that the air cannot be introduced into the ink-inducing element 47 because the ink is introduced from the sponge 37 to the end of the recording head 2 by the capillary force of the ink-inducing element 37. It is also noted that the ink, air bubbles, a mixture thereof, or the like cannot get into the ink path or into the ink-inducing element by passing or penetrating through the outer peripheral surface of the ink-inducing element because the element has a region hardened by the binder resin or the like.

Furthermore, at the time or separating the recording head 2 and the ink cartridge 3, the ink-inducing element 47 is released from the compressive pressure of the inlet portion of the recording head 2 and then moves toward the opening 391 of the ink cartridge by stability of the sponge 37, which is the force of restoring the original state. In the ink cartridge 3, as shown in the figure, a support means 49 in the form of plate is formed so as to stand on the inner peripheral surface of a boundary between the supporting region 41 and the ink outlet opening 391 and also it stands out in a diametrical direction, and thus the ink-inducing element 47 cannot protrude from the opening 391 because the ink-inducing element 47 comes to stop against a supporting means 49 and an edge oaf the head-side end of the ink-inducing element 47 is uniformly press-touched with the support means 49.

Consequently, the air cannot get into the ink cartridge 2 through the opening. It is noted that the sponge 37 is being press-touched with the ink-inducing element 47 even if the recording head 2 and the ink cartridge 3 are separated, so that there is no possibility to form an air layer between their contacted faces.

Accordingly, the ink cartridge 3 of the present embodiment is constructed so as to release the air from the ink-supply portion to the outside by way of the inner space of the ink cartridge 3 by means of the air-communicating port 48 and the air path 42 formed between the ink-inducing element 47 and the supporting region 41, while the ink-inducing element 47 is press-touched with the sponge 37. Therefore, the ink cartridge 3 of the present embodiment permits the air so as to come in and go out thereof without any control even if its inner pressure relative to an external atmospheric pressure will be increased or decreased.

Therefore, the ink cartridge 3 of the present embodiment does not cause troubles such as ink leakage from the opening or the connected portion, and penetration of the ink into the ink path. Also the ink cartridge 3 of the present embodiment is able to introduce the air from the outside in accordance with decrease in the amount or the ink by ink consumption.

<Embodiment 4>

A recording unit of the present embodiment is the same as that of Embodiments 1, 2 or 3, except that as a substitute for the grooves 42 formed in the supporting region 41 of the ink cartridge the present embodiment has an air path in a peripheral surface of the ink-inducing element.

Figure 15:
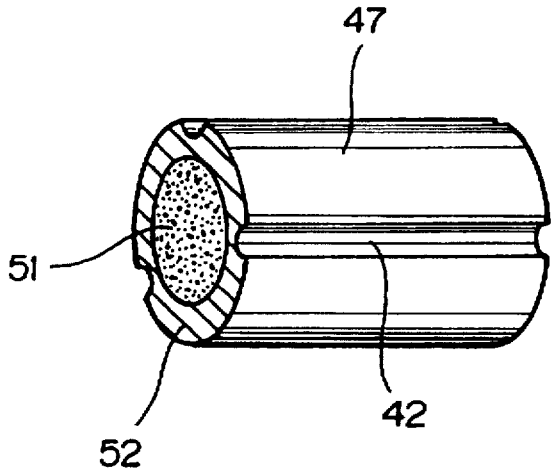
FIG. 15 is a perspective view of an ink-inducing element in accordance with the fourth embodiment of the present invention.

FIG. 15 is a cross sectional view of the ink-inducing element to be used in the recording unit of the present embodiment.

The ink-inducing element is composed of an inner region 51, a binder region 52, and a plurality of grooves 42. Each groove 42 is formed on a peripheral surface of the element. The groove 42 can be easily formed by pressing the peripheral surface of a bundle of fibers during the steps of preparing the bundle.

Accordingly, this kind of the structure is preferable to provide a more cost-effective ink cartridge compared with that of the other embodiments because it can be easily processed from the point of simplifying the process and also from the point of improving the precision of the processing. On the other hand, in the case of the ink cartridge having the grooves in the supporting region of the inner side thereof, cutting or working on the supporting region is comparatively more difficult.

<Embodiment 5>

Figure 16:
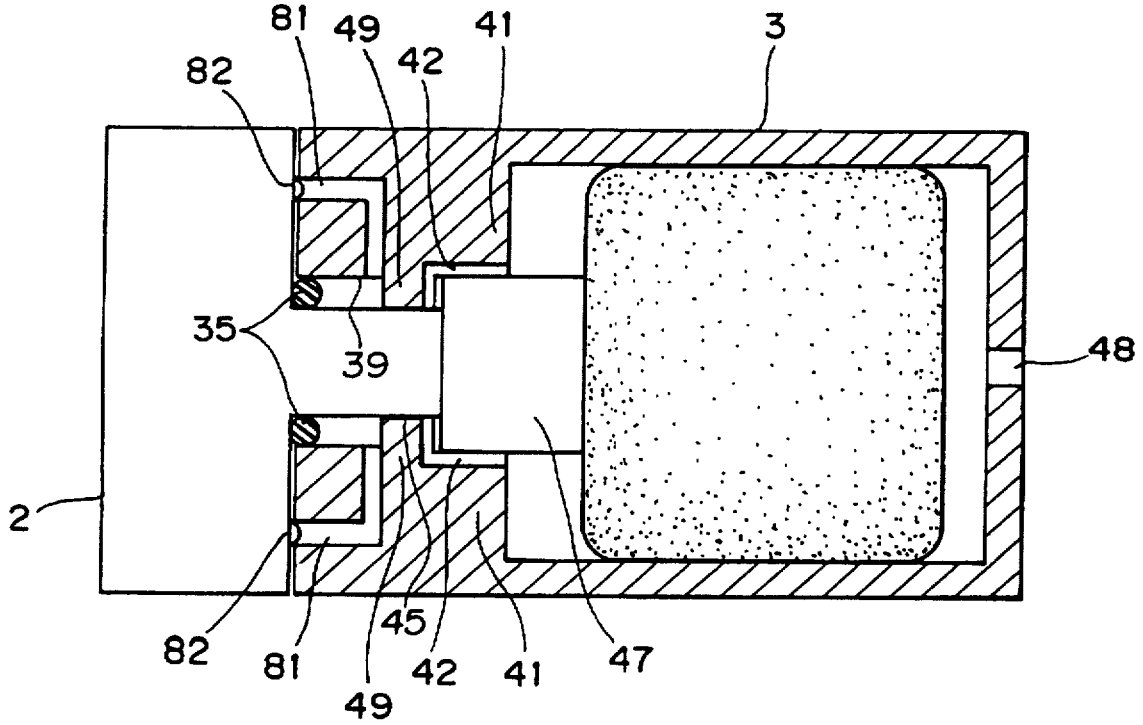
FIG. 16 is a cross sectional view of an ink-jet recording unit using a filter instead of the ink-inducing element in which a recording head is connected with an ink cartridge.

FIG. 16 shows an ink-jet recording unit as another embodiment of the present invention, in which an ink cartridge has the same structure as that of one of Embodiments 1–4, except that two different air paths are formed therein.

The first air path is the same one as that of Embodiment 3. That is, the first air path is composed of: a first spaced region formed by a plurality of the projection (i.e., ribs) 3*a* on the inner wall of the ink cartridge 3, which communicates to the external atmosphere through the air-communicating port 48; and a second spaced region formed by the grooves 42 between the ink-inducing element 47 and the surface of the supporting region 41.

The second air path is composed of a spaced region (i.e., a third spaced region) formed by at least one air-communicating port 81 (in the figure, two ports are shown) opened at the front side to be faced to the recording head. The air-communicating port 81 leads to a part of the ink-supply portion 39 where the ink-inlet portion 45 or the recording head 2 is inserted.

At the time of connecting the recording head 2 with the ink cartridge 3, an outer peripheral surface of the ink-inlet portion 45 of the recording head 2 is contacted with a corresponding inner peripheral surface of the ink-supply portion 39 of the ink cartridge 3. At this time, also, the projections 82 on the recording head 2 shuts the air-communicating ports 81 of the ink cartridge 3.

Therefore, at that time the air pressed against the ink-inducing element 47 by the ink-inlet portion 45 of the recording head 2 can be escaped to the external atmosphere through the first and the second air communicating paths. It is noted that the air cannot get into the ink-inducing element 47 and also the ink cannot flow out from the ink-inducing element 47 to the air paths because the peripheral surface of the ink-inducing element 47 is hardened by the binder.

According to the structure described above, furthermore, the second air path is in the state of communicating with the external atmosphere until the recording head is completely connected with the ink cartridge. After the connection, on the other hand, the second air path is tightly closed by the projection to perfectly seal the connected portion between the recording head and the ink cartridge.

The ink cartridge described above has two different air paths but not limited to, it is possible to use the ink cartridge with only the second path if it is enough to escape the air sufficiently to the external atmosphere.

Figure 17A:
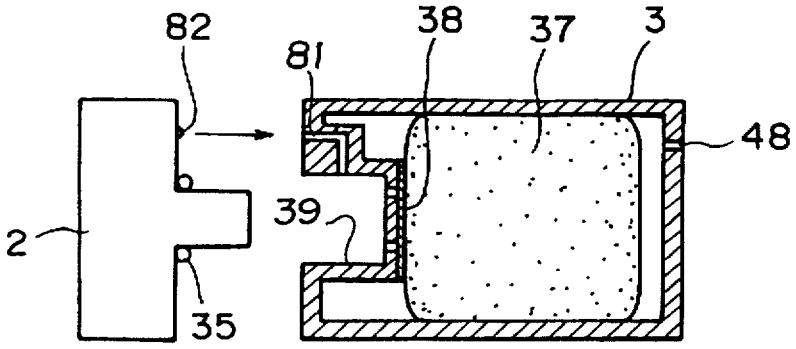
FIG. 17A is a cross sectional view of an ink-jet recording unit using a filter instead of the ink-inducing element, in which a recording head is removed from an ink cartridge.
Figure 17B:
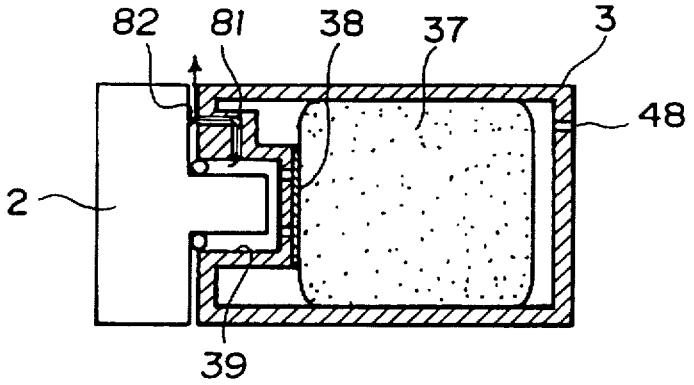
FIG. 17B is a cross-sectional view of an ink-jet recording unit according to the present invention, in which a recording head is in the course of connecting with an ink cartridge.
Figure 17C:
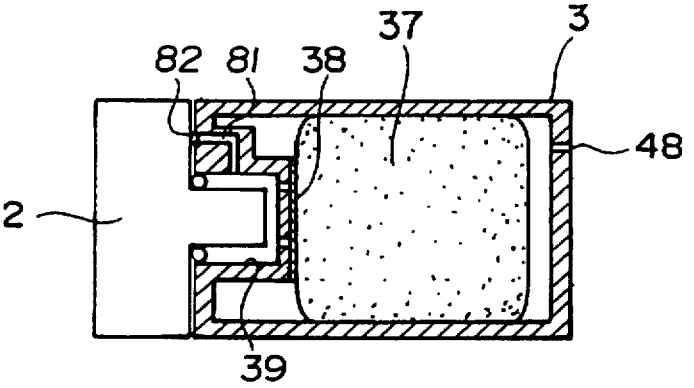
FIG. 17C is a cross-sectional view of an ink-jet recording unit according to the present invention, in which a recording head is connected with an ink cartridge.

Furthermore, the second air path can be formed in the ink cartridge in the type of pressing the sponge by means of filter without the conventional valve mechanism or the ink-inducing element of the present invention. It makes the stable ink supply from the ink cartridge to the recording head by preventing the generation of air-bubbles at the press-touched point between the filter and the sponge One of the embodiment of such ink cartridge is shown in FIGS. 17A–17C. In these figures, FIG. 17A shows a state of before the connect ion, in which the recording head 2 is removed from the ink cartridge 3; FIG. 17B shows a state of escaping the air on the way of the connection; and FIG. 17C shows a state of after the connection.

According to the structure as shown in FIGS. 17A–17C, consequently, the air can be escaped from the ink-supply portion 39 to the external atmosphere. However, we recommends the ink cartridge having the ink-inducing element for supplying the ink more stable compared with the one with the filter instead of the ink-inducing element.

Comparing with that of Embodiments 1 and 2, the ink cartridges having the air paths as described in Embodiments 3–5 endure a bad environmental condition such as a distribution in which positioning or allocation or the ink cartridge within a wide area is performed.

Figure 18B:
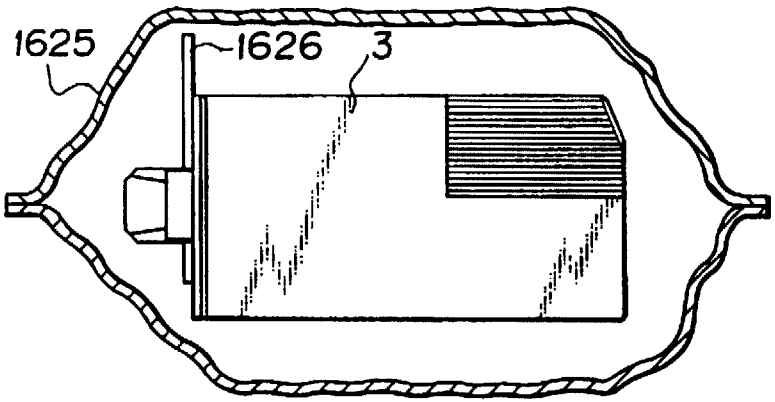
FIG. 18B is a side view of an ink-jet recording ink cartridge in a package according to the present invention.
Figure 18C:
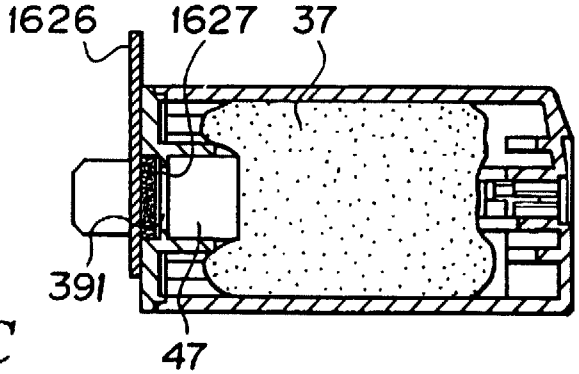
FIG. 18C is a side view of an ink-jet recording ink cartridge according to the present invention.
Figure 18A:
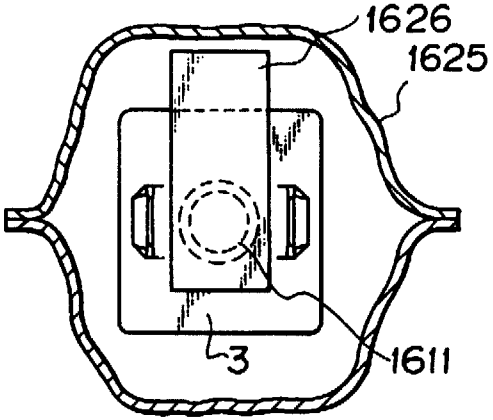
FIG. 18A is a front view of an ink-jet recording ink cartridge in a package according to the present invention.

During the distribution, in general, the ink cartridge is packed in a package as shown in FIGS. 18A–18C. FIGS. 18A and 18B are end and side views of the ink cartridge in the package, respectively. FIG. 18C is a sectional side view of the ink cartridge in the package to explain the condition for safe keeping.

The package 1625 is a heat-sealed bag of aluminum laminate for preventing an evaporation of ink during the distribution or storing of the ink cartridge for a long time.

In the package 1625, an opening (i.e., an ink-outlet) 391 of the ink cartridge 3 is sealed by a seal tape 1626 to prevent the leakage of ink from the cartridge in the bad environmental condition during the distribution. The seal tape 1626 is stuck on the ink cartridge 3 by means of heat-fusion, but it is easily stripped off when the cartridge 3 is used.

The seal cape 1626 is prepared from a material such as polyethylene, nylon, polyether, polyethylene, aluminum leaf, and a mixture thereof. It is also available to use complex laminate film as the material of the seal tape 1626.

Furthermore it is preferable to use the same material as that of the ink cartridge 3 to obtain a good contact at the fused point between the seal tape and the ink cartridge.

The seal tape 1626 used by the inventions of the present invention is a laminated layers of polypropylene, aluminum, and polyester according to the material for being made of polypropylene. A pad 1627 for absorbing the ink to be leaked is placed between the seal tape 1626 and the ink-inducing element 47. One end of the pad 1627 is adhered to the seal tape 1626 by means of heat fusion.

The ink-absorbing pad 1627 is provided for absorbing the leaked ink from the ink-inducing element 47 to prevent scattering of a small amount of the leaked ink at the time of that the seal tape is stripped off from the ink cartridge.

A material for the ink-absorbing pad 1627 can be selected from anything that has the properties of absorbing and keeping the ink, for example expanded resins such as PVA (polysvinylalcohol), polypropylene, polyester, polyethylene, polyurethane, and nylon; and fibriform materials such as paper and cloth.

In the present embodiment, an expanded resin of polypropylene is used for the ink-absorbing pad 1627, which fuse suitably to the seal tape 1626 by means of heat. According to the package and the seal tape described above, the ink cartridges of Embodiments 1–4 can be safely kept during the distribution.

Furthermore, there is a possibility of extremely increasing a surrounding temperature or extremely decreasing a surrounding pressure during the distribution or the ink cartridge. These environmental changes sometimes affect on an inner condition of the ink cartridge regardless or existing the package. This affected states of the ink cartridge are explained below referring FIGS. 19A–19D.

Figure 19A:
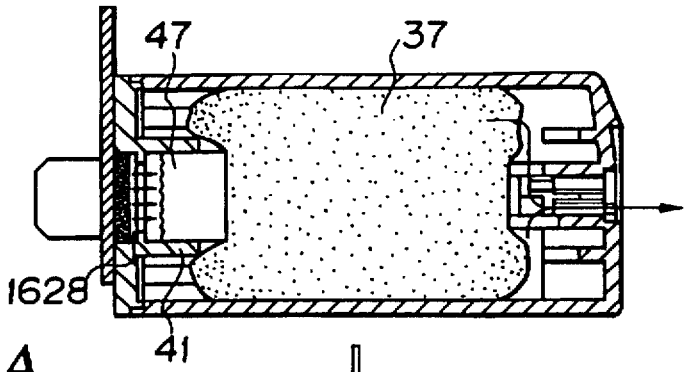
FIG. 19A is a side view of an ink-jet recording ink cartridge according to the present invention, and shows a state at the time of placing the ink cartridge in an atmosphere at a high temperature.
Figure 19B:
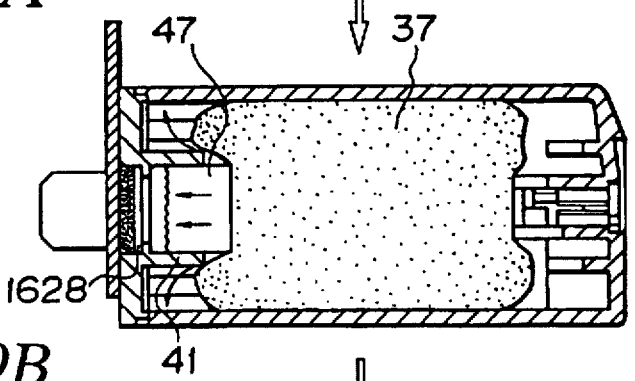
FIG. 19B shows a state of that the ink cartridge is kept in the atmosphere at a high temperature.
Figure 19C:
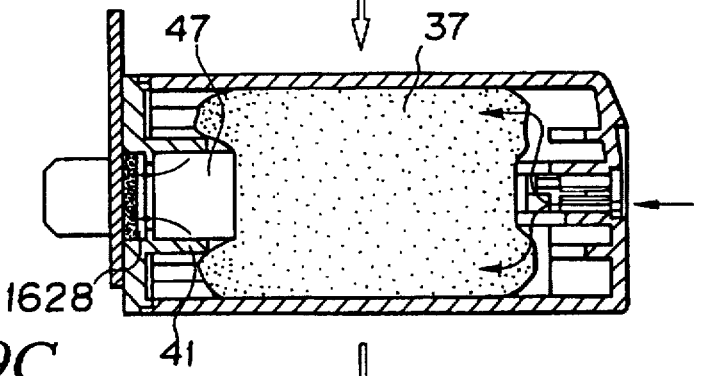
FIG. 19C shows a state at the time of placing the ink cartridge in an atmosphere at a room temperature after the state of FIG. 19B.
Figure 19D:
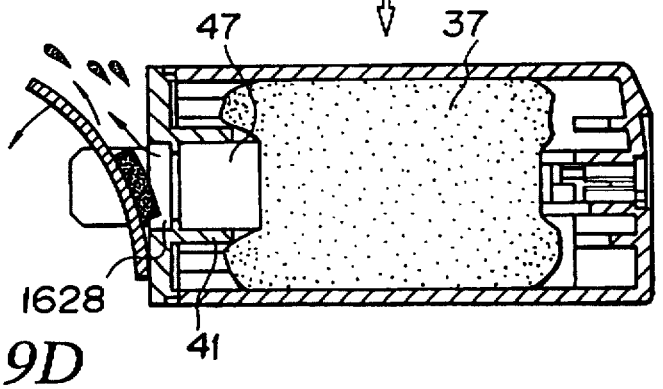
FIG. 19D shows a state of taking the seal tape off from the ink cartridge after the state of FIG. 20C.

In these figures, FIG. 19A shows a state at the time of placing the ink cartridge in an atmosphere at a high temperature; FIG. 19B shows a state of that the ink cartridge is kept in the atmosphere at a high temperature; FIG. 19C shows a state at the time of placing the ink cartridge in an atmosphere at a room temperature after the state of FIG. 19B; and FIG. 19D is a state of taking the seal tape of f from the ink cartridge after the state of FIG. 19C.

In the case that the external surroundings of the ink cartridge is changed, as shown FIG. 19A, a pressure in space 1628 between the seal tape 1626 and the ink-inducing element 47 is increased and greater than that of the external atmosphere of the ink cartridge, resulting that the air in the ink cartridge 3 attempts to escape to the external atmosphere.

In the structure such that the ink-inducing element 47 is close contacted with the supporting region 41 or with narrowly space therebetween or an air communicating through the space between the ink-inducing element 47 and the supporting region 41 is prevented by means of surface tension by caused ink, the air gets into the ink-inducing element and it presses the ink toward the backward direction.

The pressed ink is always subjected to a capillary force which press the air to the front side of the ink-inducing element 47 as shown in FIG. 19C, resulting that the air escapes gradually from the space between the ink-inducing element 47 and the supporting means 41 and finally the pressure of the space 1628 i s equalized to the pressure of the external atmosphere When the surrounding temperature and the atmospheric pressure are returned to the normal condition, the force of introducing the air into the space is generated and then the force acts on the ink in the ink absorber 37 of the porous material for holding the ink. Accordingly, the ink leaks out from the ink-inducing element 47.

In general, the leaked ink may be quickly absorbed by the ink pad however, a certain amount of the ink may remains in the space 1628 in the case that the ink cartridge is put in a sever environment such that the amount of the leaked ink is greater than an absorbing capacity of the ink pad.

In such a case, as shown in FIG. 19D, the ink is splashed in the air and gets the room dirty when the user takes the seal tape off from the ink-outlet portion of the ink cartridge.

FIGS. 20A–20D are illustrating views showing the ink cartridge of Embodiment 3 in which an air path 42 is formed so as to improve the condition shown in FIGS. 19A–19D.

Figure 20A:
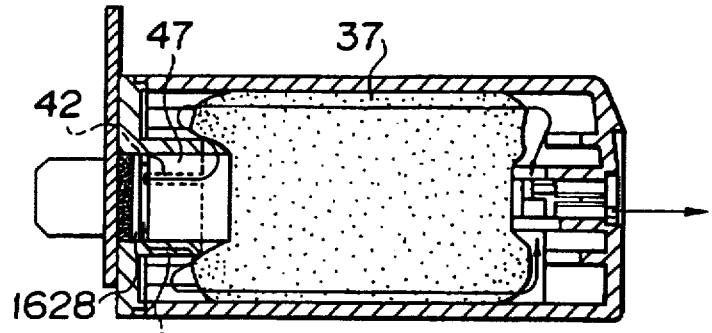
FIG. 20A is a side view of an ink-jet recording ink cartridge according to the present invention, and shows a state at the time of placing the ink cartridge in an atmosphere at a high temperature.
Figure 20B:
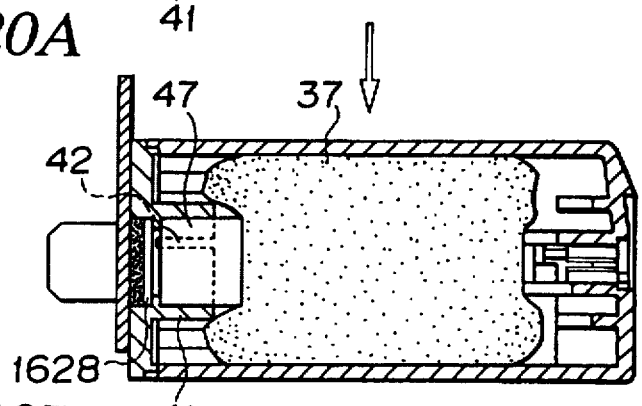
FIG. 20B shows a state or that the ink cartridge is kept in the atmosphere at a high temperature.
Figure 20C:
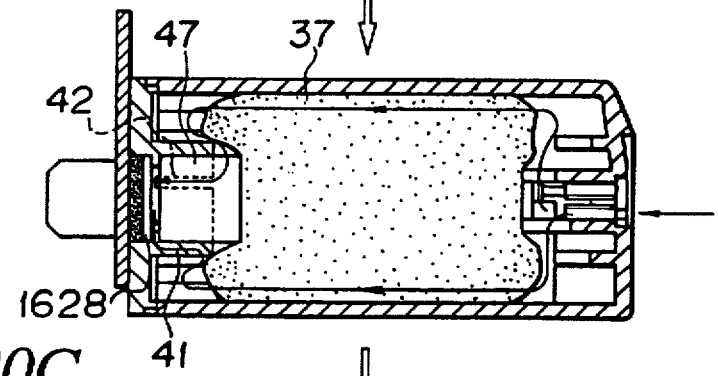
FIG. 20C shows a state at the time of placing the ink cartridge in an atmosphere at a room temperature after the state of FIG. 20B.
Figure 20D:
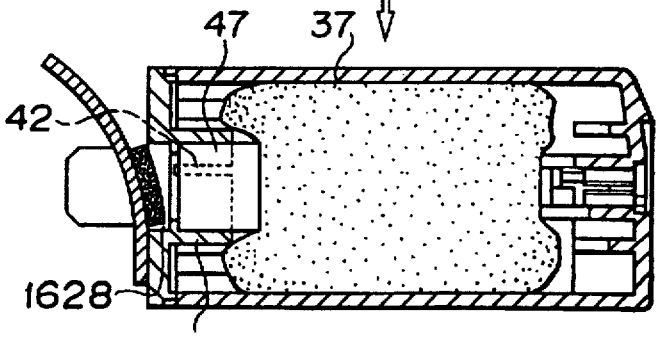
FIG. 20D shows a state of taking the seal tape off from the ink cartridge after the state of FIG. 20C.

FIG. 20A shows a state at the time of placing the ink cartridge in an atmosphere at a high temperature; FIG. 20B shows a state of that the ink cartridge is kept in the atmosphere at a high temperature; FIG. 20C shows a state at the time of placing the ink cartridge in an atmosphere at a room temperature after the state of FIG. 20B; and FIG. 20D is a state of taking the seal tape off from the ink cartridge after the state of FIG. 20C.

The ink cartridge is newly-devised so as to escape the air in the space 1628 to the external atmosphere through both an air path 42 and an inner part of the ink cartridge. The air path 42 is formed between the ink-inducing element 47 for supplying the ink and the support region 41 for supporting the ink-inducing element 47.

As easily understandable from the description above, the communication of air between the space described above and the external atmosphere is done without any restriction regardless of increasing or decreasing of relative pressure of the air in the space to the external atmosphere. Consequently, the ink leakage shown in FIG. 19D is prevented from occurring in the ink cartridge and thus the ink cartridge of the present invention becomes have improved reliability of the distribution.

The ink cartridges of the embodiments 1–5 have their novel structures by which their excellent properties can be exhibited in the ink-jet recording apparatus to be designed as a small-sized one.

<Embodiment 6>

In this embodiment, one example of concrete dimensions of the ink cartridge will be explained below.

Figure 21A:
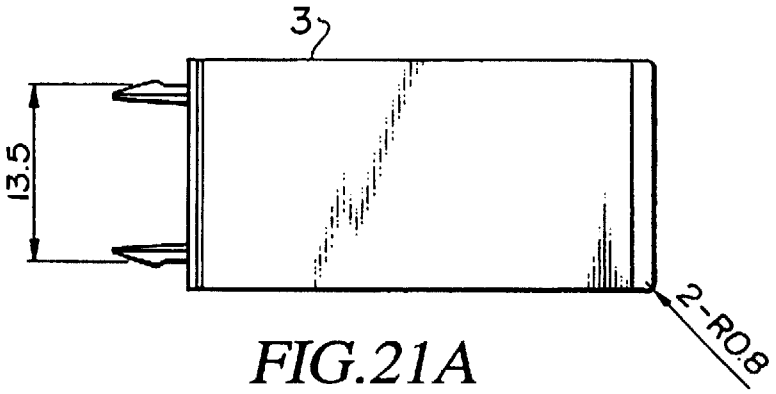
FIG. 21A is a top view of an ink-jet recording ink cartridge according to the present invention.
Figure 21B:
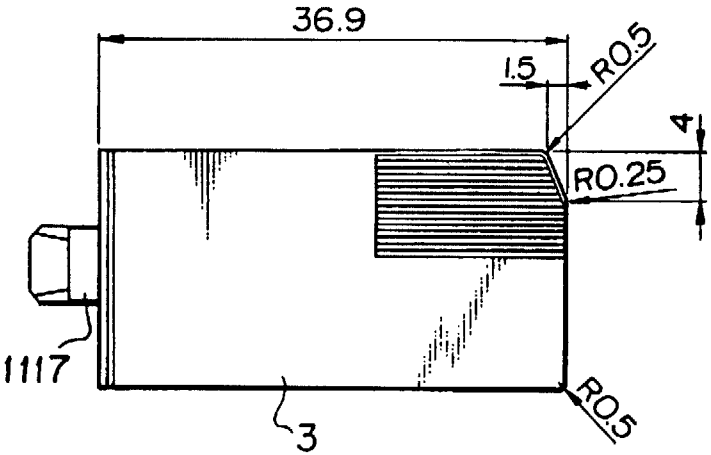
FIG. 21B is a side view of an ink-jet recording ink cartridge according to the present invention.
Figure 21C:
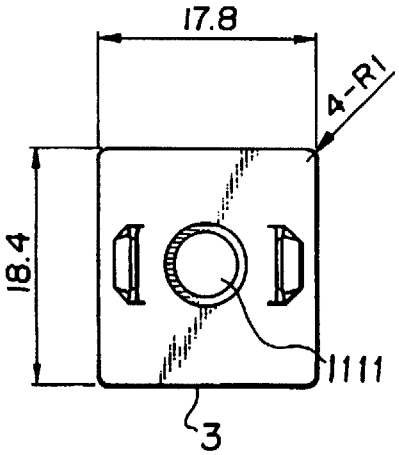
FIG. 21C is a front (i.e., an ink-outlet side) view or an ink-jet recording ink cartridge according to the present invention.
Figure 21D:
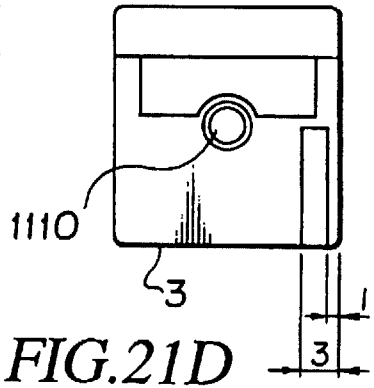
FIG. 21D is a back (i.e., an air-communicating port side) view of an ink-jet recording ink cartridge according to the present invention.

FIGS. 21A–21D show an external appearance of the ink cartridge. In these FIGS., FIG. 21A is a top plan view, FIG. 21B is a side view, FIG. 21C is a view shown from ink-outlet side, and FIG. 21D is a view shown from an air-communicating port side.

In addition, FIGS. 22A, 23B, 23C, and 22D are cross-sectional views taken on line A–A of FIG. 21A, B–B of FIG. 21B, C–C of FIG. 21B, and D–D of FIG. 21B, respectively.

In this embodiment, a supporting region 41 for supporting the ink-inducing element has a diameter of 6.85 mm.

It is preferable to adapt the structure in which the ink-inducing element is placed in a center region of a cross-sectional plane perpendicular to a direction off supplying ink from the ink cartridge. Accordingly, the ink-inducing element can be press-touched to a center region of the ink-absorber.

By using the structure mentioned above, the ink can be uniformly moved toward the ink-inducing element when the ink-inducing element inducing the ink stored in the ink absorber.

As a result the ink remaining in the ink absorber are uniformly distributed, therefore, the ink can be constantly supplied to the recording head during the period of supplying the ink depending on an ink consumption, and in addition an efficiency of the ink-supply can be improved.

In this embodiment, the center region of the ink cartridge and the center region or the ink absorber are coincident with each other, but not limited to this configuration. For example, in the case of that these regions are not coincident with each other, the ink-inducing element may be press-touched to the central region of the ink absorber for obtaining the same effects as that of the present embodiment.

Figure 23:
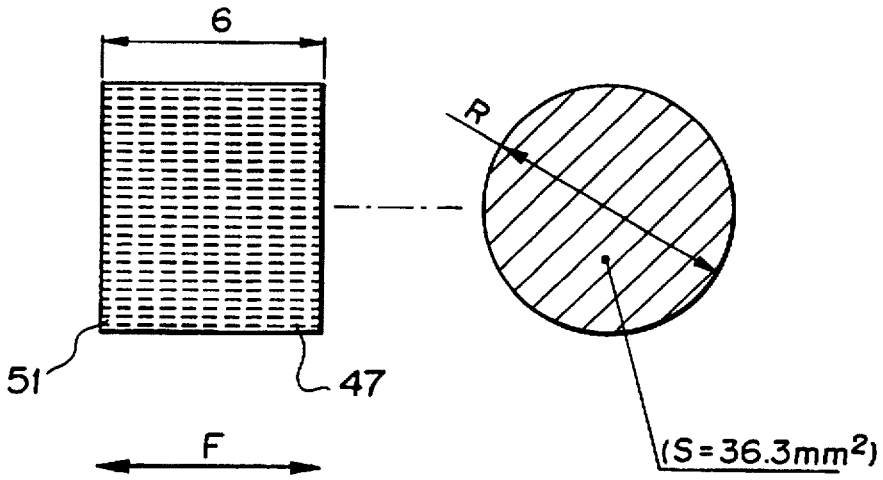
FIG. 23 is a grossly enlarged view of the ink-inducing element according to the present invention.

FIG. 23 shows a detailed configuration of the ink-inducing element 47 with a diameter of 6.8 mm in the shape of not a circle but an ellipse.

Comparing with the circular shaped one, an advantage of the elliptical shaped ink-inducing element is to more difficult to drop out from the supporting region 41.

In this embodiment, each fiber of the inducing element 47 is made of a polyester fiber with a diameter of 0.3 mm. Also, polyurethane of polyesterpolyol is used as a binder for preparing a bundle of the fibers.

Figure 24:
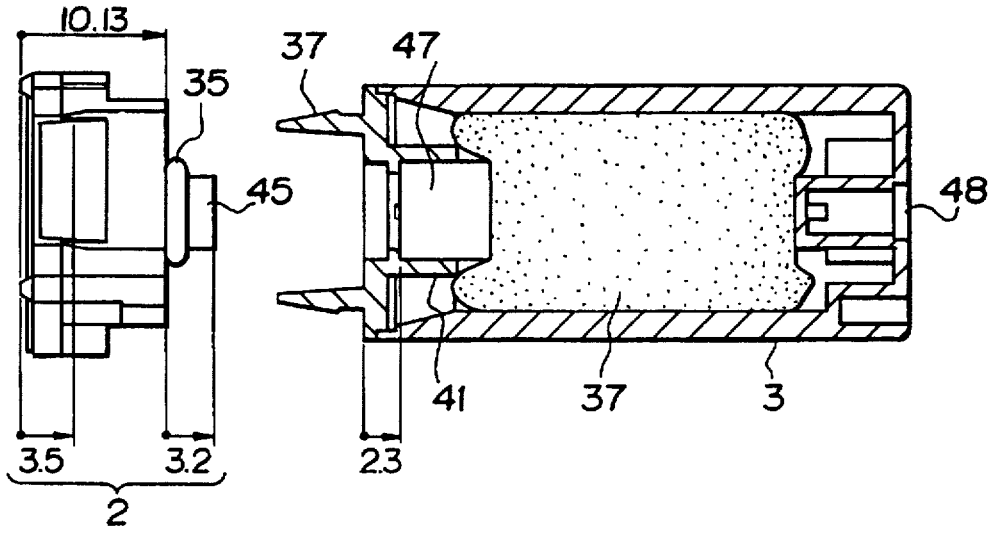
FIG. 24 is a cross sectional view of an ink-jet recording unit according to the sixth embodiment of the present invention.

FIG. 24 is a cross sectional view of the recording head 2 and the ink cartridge 3, which are already shown in FIGS. 21A–21D and FIGS. 22A–22D, for explaining their connecting relation which is maintained by connecting mechanism 37.

Figure 25:
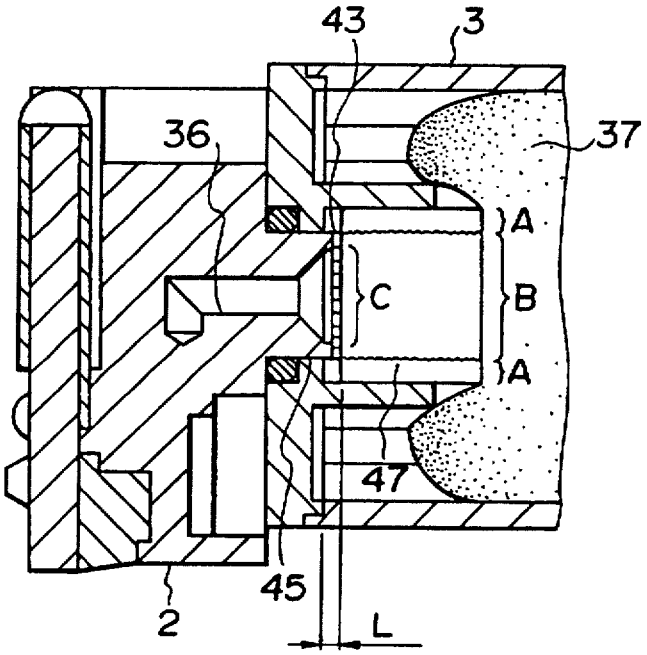
FIG. 25 is a grossly enlarged sectional view of a connected portion of the ink-jet recording head and the ink cartridge according to the sixth embodiment of the present invention.

FIG. 25 illustrates a contacted position between the filter or the ink-inlet portion and the ink-inducing element in accordance with the present embodiment. In the present embodiment, a outer peripheral surface of the ink-inlet portion 45 is positioned at a hardened region A while an area C of forming an ink path is positioned in an inner area B of the ink-inducing element.

As shown in FIG. 24, in this embodiment, the ink-inlet portion 45 is protruded with 3.2 mm in height from a contact Face between the recording head 2 and the ink cartridge, while a depth from the contact face to the ink-inducing element 47 is 2.3 mm. Consequently, the ink-inducing element 47 is able to slide with a distance L of 0.9 mm.

Therefore, a press-touched condition can be uniformly formed in a region corresponding to an effective diameter of the filter by means of pressing the region C which forms a recording head side of the ink path 36 against the inner region B of the filter 43 and the ink-inducing element 47, excluding the hardened region.

Furthermore, the press-touched condition between the filter of the ink-inlet portion and the ink-inducing element can be regulated so as to avoid a generation of creep phenomenon by means of placing the ink-inducing element slidable along a direction of inserting the ink-inlet portion of the recording head. Therefore, the filter and the ink-inducing element can be appropriately pressed touched with each other.

Thus the ink path 36 from the ink cartridge to the recording head can be formed more reliably compared with the others and thus a high printing quality can be maintained without decreasing the amount of the ink-supply by incorporating the air or the like.

Figure 22A:
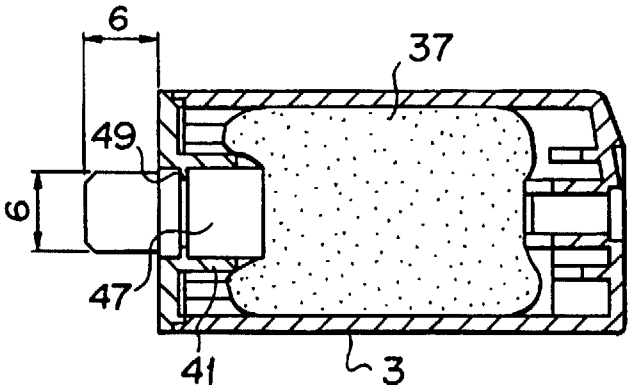
FIG. 22A is a cross sectional view taken on line A—A of FIG. 21A.
Figure 22B:
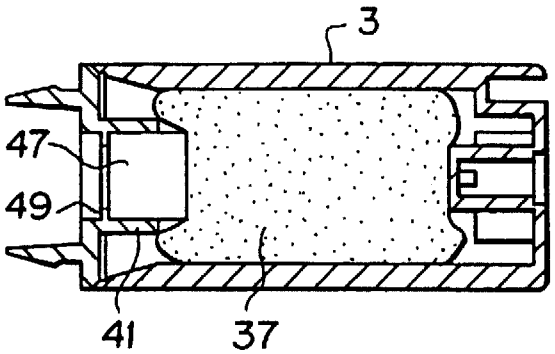
FIG. 22B is a cross sectional view taken on line B—B of FIG. 21B.
Figure 22C:
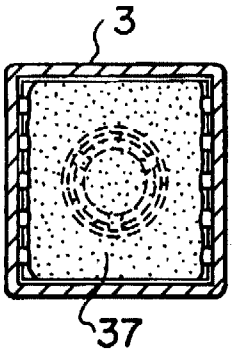
FIG. 22C is a cross sectional view taken on line C—C of FIG. 21C.
Figure 22D:
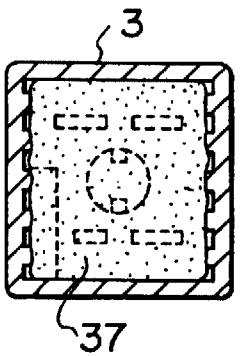
FIG. 22D is a cross sectional view taken on line D—D of FIG. 21D.

In addition to the description above, as shown in FIG. 22D, the ink cartridge of the present embodiment has the ink-inducing element which is placed in a center region of a cross-sectional plane perpendicular to a direction of supplying ink from the ink cartridge. In this case, the ink-inducing element is press-touched to a center region of the ink-inducing element.

Using the structure mentioned above, the ink stored in the ink absorber can be uniformly moved toward the center region when the ink-inducing element concentrates the ink stored in the ink absorber.

For the ink remaining in the ink absorber are uniformly distributed, therefore, the ink can be constantly supplied to the recording head during the period of supplying the ink depending on an ink consumption, and also an efficiency of the ink-supply can be improved.

In this embodiment, the center region of the ink cartridge and the center region of the ink absorber are coincident with each other, but not limited to this configuration. For example, in the case of that these regions are not coincident with each other the ink-inducing element may be press-touched to the central region of the ink absorber for obtaining the same effects as that of the present embodiment.

By the way, one of the methods for re-filling the ink cartridge with ink comprises the steps of: sucking the air in the ink cartridge through the air-communicating port 48; and filling the ink cartridge with the ink through the ink-inlet portion where the ink-inducing element is placed by using a pressure balance.

In case of decreasing the pressure of an inner part of the ink cartridge as the same way as described above, it is also possible to re-fill the ink cartridge with the ink through the air-communicating port by performing a suction through the ink-outlet portion in which the ink-inducing element is placed.

Another re-fill method can be conceivable, for example it comprises the steps of making a hole in a part of the member of the ink cartridge and injecting the ink into the ink cartridge through the hole by using a liquid injector such as a syringe. In this case, the hole may be sealed by a sealing means such as a resin.

Comparing with the valve mechanism which is a comparative embodiment of the embodiment 1, a connecting means for connecting with the re-filling device is less complicated than the valve mechanism. In case of that the step of sucking the air or re-filling the ink through the ink-outlet portion is required, the ink cartridge in accordance with the present invention, which is constructed so as to have the ink-inducing element in its ink-outlet side can be easily re-filled up with the ink From the point of re-filling the ink cartridge up with the ink and also from the point of environmental problems, therefore, the ink cartridge in accordance with the present invention is preferable one to be provided.

<Embodiment 7>

Figure 26:
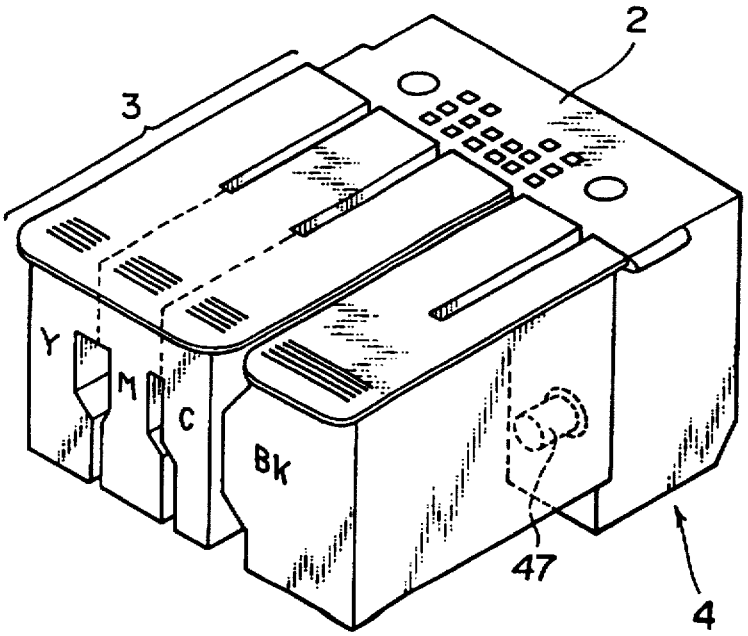
FIG. 26 is a perspective view of a color ink-jet recording head in accordance with the present invention.
Figure 27:
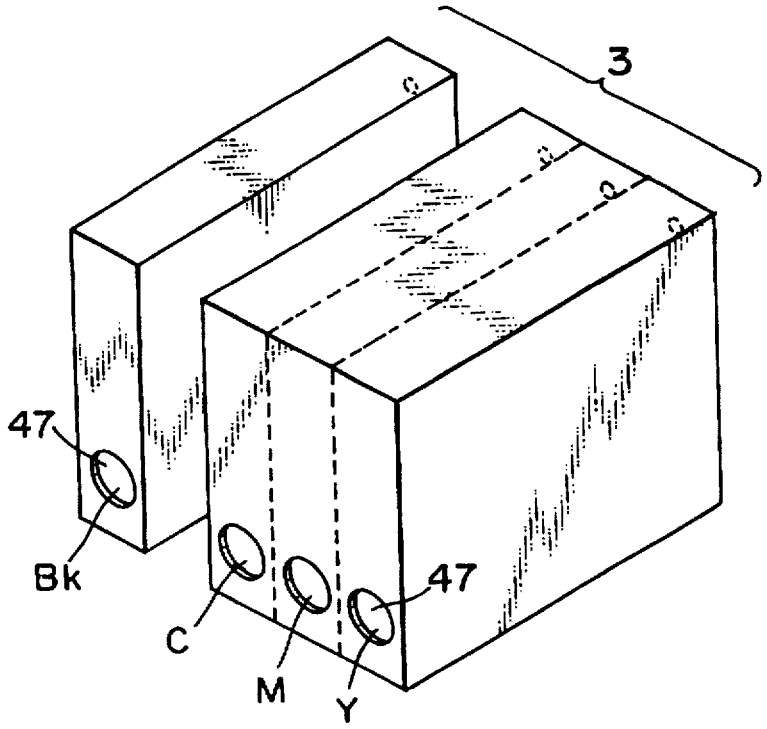
FIG. 27 is a perspective view of the color ink-jet recording head in accordance with the present invention.

Needless to say, the ink cartridge in accordance with the present invention can be applied in a full color ink-jet recording apparatus. In FIGS. 26 and 27 show one of the embodiments of the ink cartridge. FIG. 26 shows the recording unit 4 having a recording head 2 and ink cartridges Y, M, C, and Bk, while FIG. 27 shows an ink cartridge looking from the opposite direction.

As shown in these figures, the ink cartridges of Y, M, C, and Bk have ink-inducing elements 47, respectively, and thus the recording head 2 receives the ink through the ink-inducing element 47.

In FIG. 27, an out side end of the ink-inducing element 47 is exposed to the external atmosphere through an opening for connecting with the recording head 2. In this case, the ink cartridge does not leak the ink even if the opening looks down.

<Embodiment 8>

Figure 28:
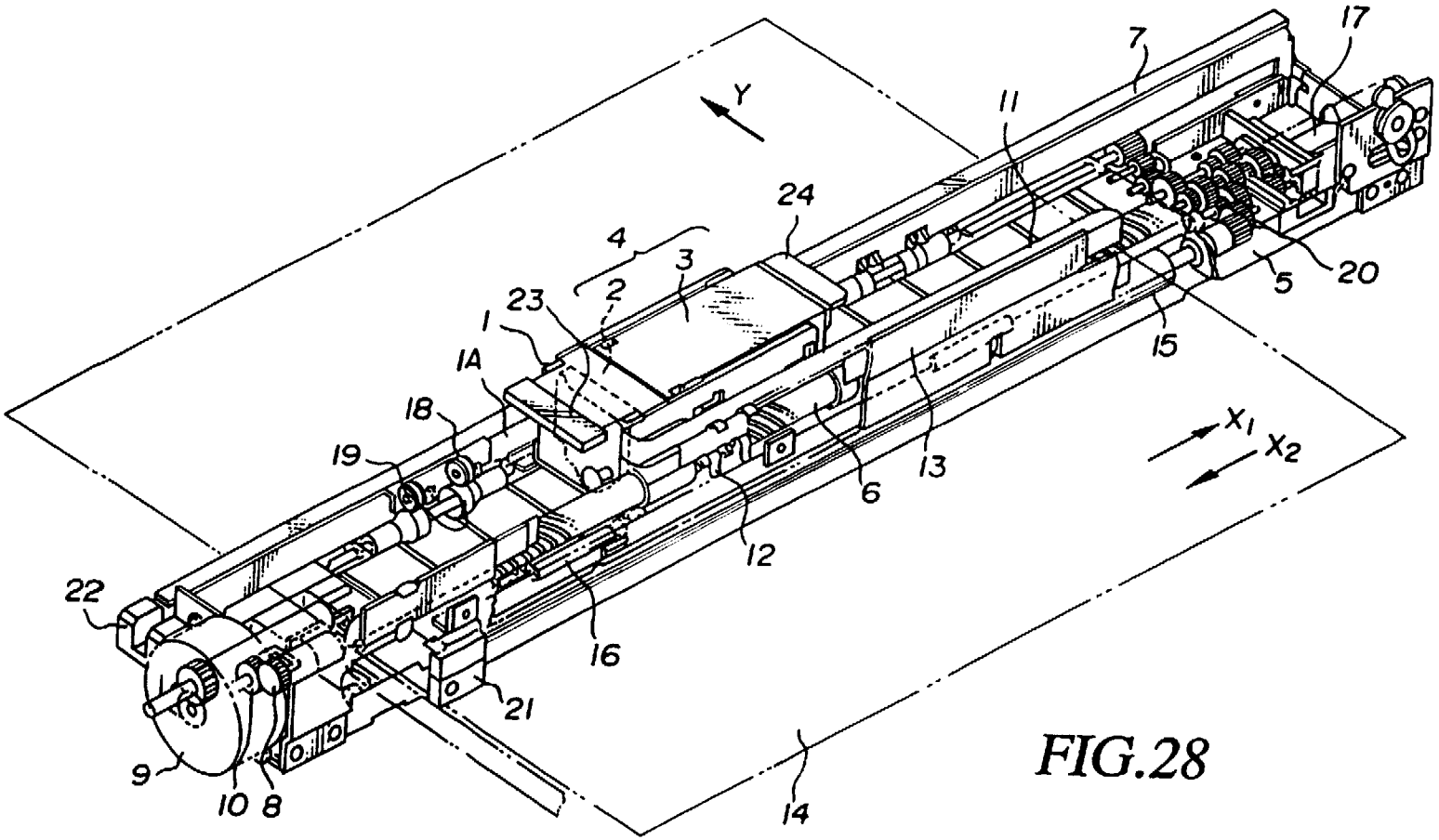
FIG. 28 is a perspective view of an ink-jet printer mechanism in accordance with of the present invention.
Figure 29:
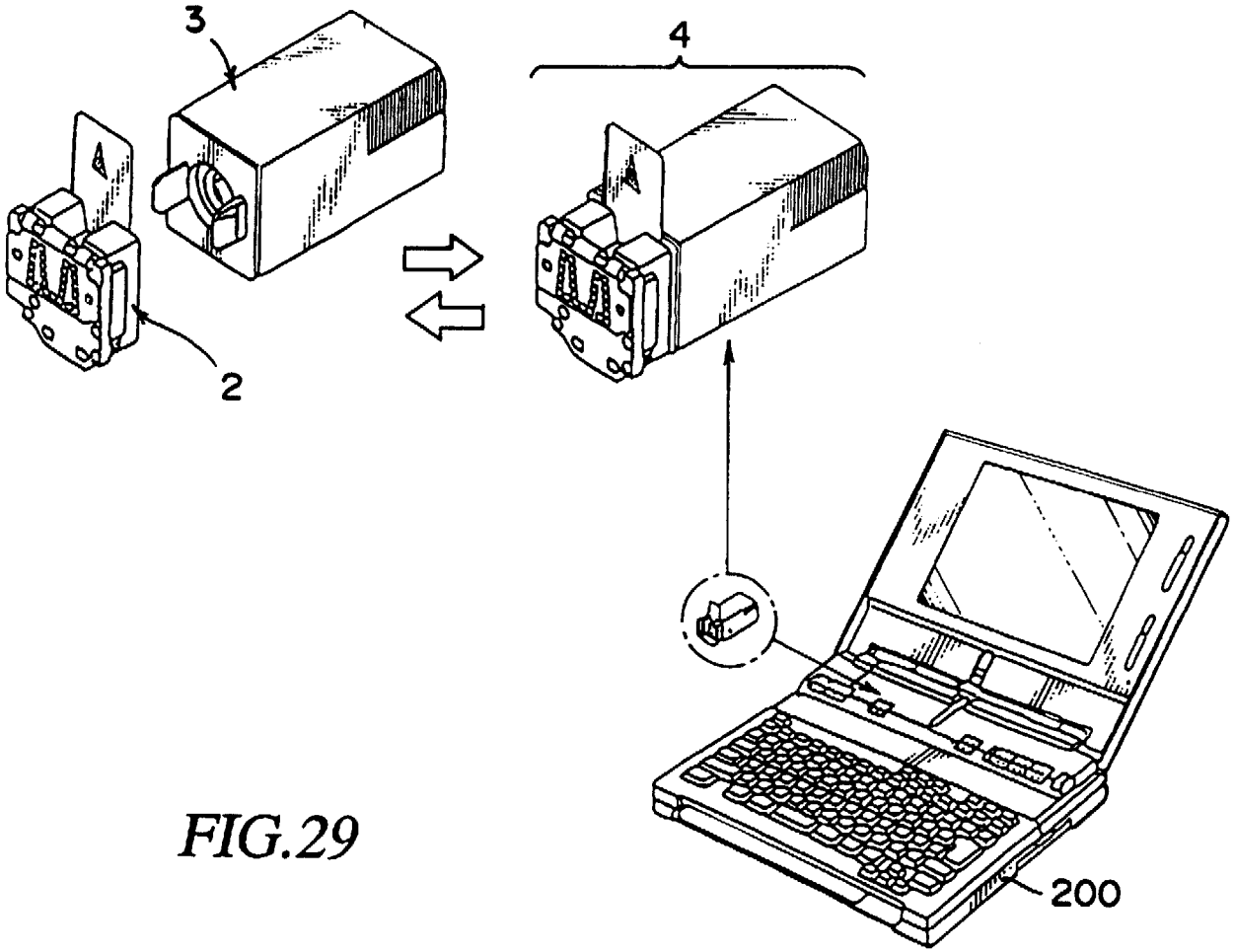
FIG. 29 is a perspective view of a personal computer in accordance with the present invention.

FIG. 28 is a perspective view of a printer mechanism using the ink-jet recording unit described above and to be equipped in a personal computer in accordance with the present invention, while FIG. 29 is a perspective view of the personal computer with the built-in printing mechanism of FIG. 28.

In FIG. 28, only the printer mechanism is shown. In this figure, the ink-jet recording unit 4 comprising the recording head 2 and the ink cartridge 3 is mounted on a carriage 1. An engaging portion is formed on an end of the carriage 1 which directs toward the recording head 2. The engaging portion is slidable engaged in a lead screw 6. The lead screw rotatable supported by a box member 5 which is provided as a frame of the body. A guide member (not shown) is provided on the other end of the carriage 1 and is slidable engaged within a guide rail 7 formed on the box member 5. Furthermore, the carriage 1 is constructed so as to move back and forth along an axial direction accompanying with a revolution of the lead screw 6 to keep its posture constantly.

Synchronizing with the back-and-forth motion of the carriage 1 described above, the ink-jet recording head 2 ejects ink droplets on a recording medium 14 to record one line of the information. That is, the recording head 2 comprises: minute fluid-ejection outlets (i.e., orifices); fluid passages and thermal energy acting portions formed on a part of these fluid passages; thermal energy generating members for generating thermal at the thermal energy acting portions to generate the thermal energy to be applied on the ink. Accordingly, the ejection of ink droplets can be performed by using the thermal energy caused by the thermal energy generating members.

After recording the one line by scanning of the carriage 1 described above, the recording medium 14 such as a sheet of recording paper is transported for the distance corresponding to the one line and then the recording unit starts to record next line. The transport of the recording medium 14 is performed by a pair of rotatable bodies composed of a transport roller 15 and a pinch roller 16 press-touched with the roller 15.

To put it more concretely, it will explained as follows:

The recording medium 14 with a surface to be recorded facing to the orifices of the recording head 2 is pressed against the transporting roller 15 by the pinch roller and it is transported for a predetermined distance enough to reach the recording position rotating the transport roller driven by a sheet feed motor.

After the recording, the recording medium 14 is pressed against a discharge roller 19 and is moved out from the apparatus by the revolution of the discharge roller 19.

The transport roller 15 and the discharge roller 19 are driven by a sheet feed mortar 17. However, transmission of the driving force is performed by a series of the reduction gears 20

A reference numeral 21 denotes a paper sensor for detecting a presence of the recording medium 14, and also a reference numeral 22 denotes a photo interrupter provided as a home-position sensor which detects whether the carriage 1 is in a home-position or not by using a shutter plate 1A for interrupting and opening a path of light beam. The shutter plate 1A is provided on the carriage 1 and moves together.

The printer mechanism described above, a discharge recovering operation 15 performed by the sucking mechanism provided on the home position of the carriage 1 when one of the recording head 2 and ink cartridge 3, or the ink-jet recording unit composed of these parts in a body is mounted on the carriage 1 Thereby a passage for supplying the ink from the sponge 37 of the ink cartridge 3 to each ink path in the recording head 2 is excellently formed.

FIG. 29 is a perspective view of the personal computer with the built-in printing mechanism of FIG. 28.

As shown n. FIG. 10, the personal computer 200 has a slot with an openable cover means which is formed at the deep end of the key board portion. Therefore the ink-jet recording unit or the like can be removably placed in the slot.

In the case of changing the ink cartridge 3 or the like, as shown in the figure, there are two ways of detaching the ink cartridge 3 from the personal computer 200. That is, the first way is detaching the ink cartridge 3 as an integrated part of the ink-jet recording unit 4, while the other way is detaching only the ink cartridge 3 from the personal computer 200.

In the case of removing the ink-jet recording unit 4 as one body, as shown in the figure, the ink-jet recording head 2 is detached from the ink cartridge 3 after removing the unit 4 from the computer 200 and then for example the recording head is attached to a new ink cartridge instead of the old one. On the other hand, in the case of removing only the ink cartridge 3, it is possible to exchange the ink cartridge without removing the recording head 2 from the computer 200.

By the way, one of the methods for re-filling the ink cartridge with ink comprises the steps of: sucking the air in the ink cartridge through the air-communicating port 48; and filling the ink cartridge with the ink through the ink-inlet portion where the ink-inducing element is placed by using a pressure balance.

In case of decreasing the pressure of an inner part of the ink cartridge in the same way as described above, it is also possible to re-fill the ink cartridge with the ink through the air-communicating port by performing a suction through the ink-outlet portion where the ink-inducing element is placed.

Another re-fill method can be conceivable, for example it comprises the steps of making a hole in a part of the member or the ink cartridge and injecting the ink into the ink cartridge through the hole by using a liquid injector such as a syringe. In this case, the hole may be sealed by a sealing means such as a resin.

Comparing with the valve mechanism, which is a comparative embodiment of Embodiment 1, a connecting means for connecting with the re-filling device is less complicated than the valve mechanism. In case of that the step of sucking the air or re-filling the ink through the ink-outlet portion is required, the ink cartridge in accordance with the present invention, which is constructed so as to have the ink-inducing element in its ink-outlet side can be easily re-filled up with the ink.

Therefore the ink cartridge according to the present invention is preferable for the recording from the point of re-filling the ink cartridge up with the ink and also from the point of environmental problems.

VARIOUS ASPECTS OF THE INVENTION

The present invention can be applied to a facsimile using an ink-jet recording apparatus of piezo-type as its recording system in which piezoelectric elements are used as elements for generating ink-ejection energy. The present invention is particularly suitably usable in an ink-jet recording head having heating elements that produce thermal energy as energy used for ink ejection and recording apparatus using the head. This is because, the high density of the picture element, and the high resolution of the recording are possible.

The typical structure and the principle are preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals by development and collapse of the bubble, the liquid (ink) is ejected through an ejection outlet to produce at least one droplet. The driving signal is preferably in the form of a pulse, because the development and collapse of the bubble can be effected instantaneously, and there fore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,33 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Application Laying-Open No. 123670/1984 wherein a common slit is used as the ejection outlet for a plurality of electrothermal transducers, and to the structure disclosed in Japanese Patent Application Laying-Open No. 138461/1984 wherein an opening for absorbing pressure wave or the thermal energy is formed corresponding to the ejecting portions This is because, the present invention ineffective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality recording head combined to cover the entire width.

In addition, the present invention, is applicable to a serial type recording head wherein the recording head is fixed an the main assembly, to a replaceable chip type recording head which is connected electrically with the main apparatus and can be supplied with the ink by being mounted in the main assembly, or to a cartridge type recording head having an integral ink container The provision of recovery means and the auxiliary means for the preliminary operation are preferable, because they can further stabilize the effect of the present invention As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As a regard the kinds and the number of the recording heads mounted, a single head corresponding to a single color ink may be equipped, or plurality of heads corresponding respectively to a plurality of ink materials having different recording color or density may be equipped.

What is claimed is:

1. An ink cartridge attached to a recording head and detachable therefrom, the recording head having an ink receiving portion, the ink cartridge comprising:

an ink-reserving portion having a space for storing ink;

an ink absorbing member housed in said ink-reserving portion to hold the ink:

an ink-supply opening portion having an opening for supplying ink from said ink-reserving portion to the ink receiving portion of the recording head;

an ink-inducing element arranged between said ink absorbing member and said ink-supply opening portion to contact said ink absorbing member so that the ink held by said ink absorbing member is induced toward the recording head;

a holding portion for holding said ink-inducing element slidably; and a restriction member for restricting movement of said ink-inducing element toward an outside of said ink cartridge to prevent said ink-inducing element from sliding to project out of said ink-supply opening portion, wherein said ink-inducing element press-contacts with the ink receiving portion of the recording head to slide said ink-inducing element toward said ink absorbing member, when said ink cartridge is attached to the recording head.

2. An ink cartridge as claimed in claim 1, wherein said bundle of fibers of said ink-inducing element has a hardened region around a peripheral surface thereof to hold said fibers together.

3. An in ink cartridge as claimed in claim 1, wherein said bundle of fibers is formed by permeating a binder into a peripheral surface of said ink-inducing element.

4. An ink cartridge as claimed in claim 1, wherein a capillary force of said ink inducing element is higher than that of said porous member, and also a pressure loss of said ink inducing element is 20 mmAq or under.

5. An ink cartridge as claimed in claim 1, wherein a capillary force of said ink inducing element is in a range of 85 mmAq to 400 mmAq.

6. An ink cartridge as claimed in claim 1, wherein an average size of space between said fibers in said ink-inducing element is in a range of 0.01 mm to 0.05 mm.

7. An ink cartridge as claimed in claim 1, wherein a length of said ink inducing element along the direction of supplying ink is in a range of 2 mm to 6 mm.

8. An ink cartridge as claimed in claim 1, wherein said ink inducing element has a region with a fiber density in said range of 100 to 200 fibers/mm$^2$.

9. An ink cartridge as claimed in claim 1, wherein an effective diameter of said ink-inducing element is in a range of 1 mm to 18 mm.

10. An ink cartridge as claimed in claim 1, wherein said ink-inducing element is disposed in a center region of a cross section of said porous member in a direction of supplying ink.

11. An ink cartridge as claimed in claim 1, wherein said ink-inducing element is disposed in a center region of a cross section of said ink cartridge in a direction of supplying said ink.

12. An ink cartridge for storing ink to be supplied to a recording head through an ink-inlet portion of said recording head, the ink cartridge being attached to the recording head and detachable therefrom, the ink cartridge comprising:

an ink-reserving portion having a space for storing ink;

an ink absorbing member housed in said ink-reserving portion to hold the ink;

an ink-supply opening portion having an opening for supplying ink from said ink-reserving portion to an ink receiving portion of the recording head;

an ink-inducing element arranged between said ink absorbing member and said ink-supply opening portion to contact with said ink absorbing member so that the ink held by said ink absorbing member is induced toward the recording head, said ink-inducing element having a first end portion press-contacting with said ink-inlet portion when said cartridge is attached to the recording head and a second end portion press-contacting with said ink absorbing member, and being formed as a bundle of fibers in which each fiber is provided along a direction extending from said first end portion to said second end portion;

a holding portion for holding said ink-inducing element slidably; and a restriction member for restricting movement of said ink-inducing element toward an outside of said ink cartridge to prevent said ink-inducing element from sliding to project out of said ink supply opening portion, wherein said first end portion of said ink-inducing element press-contacts with the ink-inlet portion of the recording head to slide said ink-inducing element toward said ink absorbing member to ensure that said second end portion is in press-contact with said ink absorbing member.

13. An ink cartridge as claimed in claim 12, wherein said first end of said ink-inducing element has an area press-contacting with an area of a filter in said ink-inlet portion of said recording head, and said former area being larger than said latter area.

14. An ink cartridge as claimed in claim 12, wherein said ink-inducing element of said ink cartridge is disposed so that a press-contacting portion of said ink-inducing element with said ink inlet portion is positioned inside of a peripheral surface of said ink-inducing element.

15. An ink cartridge as claimed in claim 14, wherein said press-contacting portion is over 0.5 mm away from said peripheral surface of said ink-inducing element along a radial direction thereof.

16. An ink cartridge as claimed in claim 12, wherein said ink-inducing element is able to slide along a direction of connecting said recording head with said ink cartridge.

17. An ink cartridge as claimed in claim 12, wherein a slide distance of said ink-inducing element is in a range of 0.1 mm to 3 mm.

18. An ink cartridge as claimed in claim 12, wherein said bundle of said fibers is made of polyester fibers with average diameters in a range or 0.01 mm to 0.05 mm.

19. An ink cartridge as claimed in claim 12, wherein said bundle of fibers of said ink-inducing element is formed by permeating a binder into a peripheral surface of said ink-inducing element.

20. An ink cartridge as claimed in claim 19, wherein said binder is polyetherpolyol urethane.

21. An ink cartridge as claimed in claim 12, wherein said ink-supply portion of said cartridge which is in an envelope is sealed with a sealing member which can be easily removed when said ink cartridge is put into use.

22. An ink cartridge as claimed in claim 21, wherein space formed between said sealing member and said ink-inducing element is communicated with space formed in said ink cartridge.

23. An ink cartridge as claimed in claim 21, wherein said sealing member is an aluminum-laminated film.

24. An ink cartridge as claimed in claim 21, wherein said sealing member comprises a plurality of layers in which at least one layer is made of polyolefin as a contact layer to be contacted with said ink cartridge by means of thermal welding.

25. An ink cartridge as claimed in claim 21, wherein an ink absorber is placed between said sealing member and said ink-inducing element.

26. An ink cartridge as claimed in claim 25, wherein said ink-absorber is made of a blowing material of polyvinyl alcohol.

27. An ink cartridge as claimed in claim 25, wherein said ink-absorber is fixed on said sealing member by means of thermal welding.

28. An ink cartridge as claimed in claim 25, wherein said ink absorber is made of same material as that of said contact layer of said sealing member.

29. An ink cartridge as claimed in claim 12, wherein said ink-inducing element is disposed in a center region of a cross section of said porous member in a direction of supplying said ink.

30. An ink cartridge as claimed in claim 12, wherein said ink-inducing element is disposed in a center region of a cross section of said ink cartridge in a direction of supplying said ink.

31. An ink cartridge as claimed in claim 12, wherein said ink-supply portion has an air path for letting air introduced into said ink cartridge from said ink-supply portion escape to an outside of said ink cartridge when said ink-inlet portion of said recording head is inserted into said ink-supply portion.

32. An ink cartridge as claimed in claim 31, wherein said air path is formed as a groove on an inner wall of said ink-supply portion.

33. An ink cartridge as claimed in claim 31, wherein said air path communicates with an air communicating port of said ink cartridge through an inner space of said ink cartridge to communicate with air outside of said ink cartridge.

34. An ink cartridge as claimed in claim 31, wherein a capillary force of said ink inducing element is higher than that of said porous member, and also a pressure loss of said restriction member is 20 mmAq or under.

35. An ink cartridge as claimed in claim 31, wherein said capillary force of said ink inducing element is in a range of 85 mmAq to 400 mmAq.

36. An ink cartridge as claimed in claim 31, wherein an average size of space between said fibers in said ink-inducing element is in a range of 0.01 mm to 0.05 mm.

37. An ink-jet recording apparatus comprising:

a recording unit including a recording head with a plurality of ejection ports; and an ink cartridge for storing ink to be supplied to said recording head through an ink-inlet portion of said recording head and being attached to the recording head and detachable therefrom, said ink cartridge having an ink-reserving portion with a space for storing ink, an ink absorbing member housed in said ink-reserving portion to hold the ink, an ink supply opening portion having an opening for supplying ink from said ink-reserving portion to an ink receiving portion of the recording head, an ink inducing element arranged between said ink absorbing member and said ink-supply opening portion to contact with said ink absorbing member so that the ink held by said ink absorbing member is induced toward the recording head, said ink-inducing element having a first end portion press-contacting with said ink-inlet portion when said ink cartridge is attached to the recording head and a second end portion press-contacting with said ink absorbing member and being formed as a bundle of fibers in which each fiber is provided along a direction extending from said first end portion to said second end portion, a holding portion for holding said ink-inducing element slidably, and a restriction member for restricting movement of said ink-inducing element toward an outside of said cartridge to prevent said ink-inducing element from sliding to project out of said ink-supply opening portion, wherein said first end portion of said ink-inducing element press-contacts with the ink-inlet portion of the recording head to slide said ink-inducing element toward said ink absorbing member to ensure that said second end portion is in press-contact with said ink absorbing member.

38. An ink-jet recording apparatus as claimed in claim 37, wherein a capillary force of said ink inducing element is higher than that of said porous member, and also a pressure loss of said ink 3inducing element is 20 mmAq or under.

39. An ink-jet recording apparatus as claimed in claim 37, wherein said ink-supply portion has an air path for letting air introduced into said ink cartridge from said ink-supply portion escape to an outside of said ink cartridge when said ink-inlet portion of said recording head is inserted into said ink-supply portion.

40. An ink-jet recording apparatus as claimed in claim 37, wherein capillary force of said ink inducing element is higher than that of said porous member and a pressure loss of said ink inducing element is 20 mmAq or under, and said ink-supply element has an air path for letting air to be introduced into said ink cartridge from said ink-supply element escape to said outside of said ink cartridge when said ink-inlet potion of said recording head is inserted into said ink-supply element.

41. An ink-jet recording unit comprising:

a recording head with a plurality of ejection ports for ejecting ink; and an ink cartridge for storing ink to be supplied to said recording head through an ink-inlet portion of said recording head and being attached to the recording head and detachable therefrom, said ink cartridge including an ink-reserving portion with a space for storing ink, an ink absorbing member housed in said ink-reserving portion to hold the ink, an ink-supply opening portion having an opening for supplying ink from said ink-reserving portion to an ink-receiving portion of the recording head, an ink inducing element arranged between said ink absorbing member and said ink-supply opening portion to contact with said ink absorbing member so that the ink held by said ink absorbing member is induced toward the recording head, said ink-inducing element having a first end portion press-contacting with said ink-inlet portion when said ink cartridge is attached to the recording head and a second end portion press-contacting with said ink absorbing member and being formed as a bundle of fibers in which each fiber is provided along a direction extending from said first end portion to said second end portion, a holding member for holding said ink-inducing element slidably, and a restriction member for restricting movement of said ink-inducing element toward an outside of said cartridge to prevent said ink-inducing element from sliding to project out of said ink-supply opening portion, wherein said first end portion of said ink-inducing element press-contacts with the ink-inlet portion of the recording head to slide said ink-inducing element toward said ink absorbing member to ensure that said second end portion is in press-contact with said ink absorbing member.

42. An ink-jet recording unit as claimed in claim 41, wherein a capillary force of said ink inducing element is higher than that of said porous member, and also a pressure loss of said ink inducing element is 20 mmAq or under.

43. An ink-jet recording unit as claimed in claim 41, wherein an air path for letting air escape to an outside is formed in said ink-supply portion which is formed when said recording head and said ink cartridge are connected with each other and is disposed in a space between said ink inducing element and a wall of said ink supply portion.

44. An ink-jet recording unit as claimed in claim 41, wherein a capillary force of said ink inducing member is higher than that of said porous member and a pressure loss of said ink inducing element 20 mmAq or under, when said recording head and said ink cartridge are connected with each other and is disposed in a space between said ink inducing element and a wall of said ink supply portion.

* * * * *

UNITED STATES PATENT AND TRADEMARK OFFICE

CERTIFICATE OF CORRECTION

PATENT NO. : 5,784,088 
DATED : July 21, 1998
INVENTOR(S) : Toshihiko Ujita, Masanori Takenouchi and Keiichiro Tsukuda It is certified that error appears in the above-identified patent and that said Letters Patent is hereby corrected as shown below:

Column 1,
Line 33, change "as" (second occurrence) to -- for --.
Line 34, delete "an".
Line 40, change "system" to -- systems --.
Line 41, change "Particular" to -- particular --.
Line 44, change "demand" to -- demands --.
Line 47, delete "a".
Line 48, change "need" to -- needed --; and change "unlit" to -- unit --.
Line 49, change "have" to -- has --.

Column 2,
Line 4, change "chat" to -- that --.
Line 5, change "Ink" to -- ink --.
Lines 15 and 19, change "or" to -- of --.
Line 36, change "have" to -- has --.
Line 41, change "prevents" to -- prevent --.

Column 3,
Line 23, delete "(".
Line 24, delete ")".
Lines 29 and 35, change "formed" to -- formed. --
Line 41, delete "the".
Line 44, change "A" to -- An --.
Line 49, change "prevent" to -- prevents --.

Column 4,
Line 2, change "matters" to -- matter --.
Lines 6 and 44, change "or" to -- of --.
Line 17, change "prevent" to -- prevents --.
Line 18, change "supply" to -- supplies --.
Line 53, delete "to".

Column 5,
Line 32, delete "to".

Column 6,
Line 6, change "so" to -- of --.

UNITED STATES PATENT AND TRADEMARK OFFICE

CERTIFICATE OF CORRECTION

PATENT NO. : 5,784,088
DATED : July 21, 1998
INVENTOR(S) : Toshihiko Ujita, Masanori Takenouchi and Keiichiro Tsukuda It is certified that error appears in the above-identified patent and that said Letters Patent is hereby corrected as shown below:

Column 7,
Line 2, change "or" to -- of --.

Column 8,
Line 7, change "or" to -- of --.
Line 45, change "one" to -- the --; and change "which" to -- with --.
Line 64, change "foxed" to -- formed --.

Column 9,
Line 14, change "a" to -- an --.
Line 22, delete "figures, the".
Lines 42 and 48, change "or" to -- of --.

Column 10,
Line 7, change "apparatus" to -- apparatus. --.
Line 35, delete "a" (first occurrence).
Line 56, change "other" to -- another --.

Column 11,
Line 29, change "polyestherpolyol" to -- polyetherpolyol --.
Line 30, delete "to".
Line 31, change "embodiment" to -- example --.
Line 38, change "In stead" to -- Instead --.
Line 39, change "or" to -- of --.
Line 41, change "because of" to -- for --.
Line 48, delete "of".
Line 49, change "it is" to -- they are --; and change "its" to -- their --.
Line 52, change "it" to -- if --.
Line 63, change "the." to -- the --.

Column 12,
Line 4, change "defines" to -- define --.
Line 9, change "is" to -- are --.
Line 38, change "hand" to -- hard --.
Line 39, delete "on".
Line 61, change "or" to -- of --.

UNITED STATES PATENT AND TRADEMARK OFFICE

CERTIFICATE OF CORRECTION

PATENT NO. : 5,784,088
DATED : July 21, 1998
INVENTOR(S) : Toshihiko Ujita, Masanori Takenouchi and Keiichiro Tsukuda It is certified that error appears in the above-identified patent and that said Letters Patent is hereby corrected as shown below:

Column 13,
Line 22, change "need" to -- needed --.
Line 23, change "maintain" to -- maintains --.
Line 39, change "above" to -- above. --.

Column 14,
Line 11, change "follows" to -- follows. --.
Line 40, after "preferably" insert -- be --.
Line 66, change "In" to -- If --.

Column 15,
Line 33, change "[mzm]" to -- [mm] --.
Line 57, change "&,nouns" to -- amount --.

Column 16,
Line 35, change "namer" to -- number --.
Line 41, change "or" to -- of --.
Line 47, change "force" to -- force. --.
Line 54, change "For" to -- for --.
Line 64, change "embodiment" to -- example, --.

Column 17,
Line 6, change "embodiment" to -- example --.
Line 27, delete "is".
Line 58, before "an" insert -- shows --.

Column 18,
Line 6, change "E" to -- B --.
Line 60, change "Proposed" to -- proposed --.
Line 66, delete "become".
Line 67, change "glowing" to -- grows --.

Column 19,
Line 5, change "off" to -- of --.
Line 9, change "or" to -- of --.

UNITED STATES PATENT AND TRADEMARK OFFICE

CERTIFICATE OF CORRECTION

PATENT NO. : 5,784,088
DATED : July 21, 1998
INVENTOR(S) : Toshihiko Ujita, Masanori Takenouchi and Keiichiro Tsukuda It is certified that error appears in the above-identified patent and that said Letters Patent is hereby corrected as shown below:

Column 19,
Line 31, change "Provided" to -- provided --.
Line 32, change "i s" to -- is --.

Column 20,
Line 8, change "ol" to -- of --.
Line 29, change "irk" to -- ink --.
Line 38, change "In" to -- It --.
Line 64, change "push" to -- pushed --.

Column 21,
Line 44, after "sure" insert -- of --.
Line 46, change "press-inert" to -- press-insert --.

Column 22,
Line 3, after "or" insert -- is --.
Line 6, change "deteriorate" to -- deteriorates --.
Line 11, change "Pressed" to -- pressed --.
Line 15, change "For" to -- for --.
Line 25, change "perfectly" to -- perfectly. --.
Lines 37 and 39, change "or" to -- of --.

Column 23,
Line 6, change "out side" to -- outside --.
Lines 19 and 56, change "or" to -- of --.
Line 32, change "oaf" to -- of --.
Line 48, delete "so as".

Column 24,
Line 22, change "projection" to -- projections --.
Line 40, change "projections" to -- projection --.
Line 67, change "sponge" to -- sponge. --.

UNITED STATES PATENT AND TRADEMARK OFFICE

CERTIFICATE OF CORRECTION

PATENT NO. : 5,784,088
DATED : July 21, 1998
INVENTOR(S) : Toshihiko Ujita, Masanori Takenouchi and Keiichiro Tsukuda It is certified that error appears in the above-identified patent and that said Letters Patent is hereby corrected as shown below:

Column 25,
Line 1, change "embodiment" to -- embodiments --.
Line 3, change "connect ion" to -- connection --.
Line 10, change "mends" to -- mend --.
Line 33, change "cape" to -- tape --.
Line 40, delete "inventions of the".
Line 41, delete "a".
Line 54, change "(polysvinylalcohol)" to -- (polyvinylalcohol) --.
Line 58, change "fuse" to -- fuses --.
Lines 65 and 67, change "or" to -- of --.

Column 26,
Line 1, change "This" to -- The --.
Line 2, after "referring" insert -- to --.
Line 9, change "of f" to -- off --.
Line 20, change "narrowly" to -- a narrow --.
Line 23, change "by caused" to -- caused by --.
Line 27, change "press" to -- presses --.
Line 31, change "i s" to -- is --.
Line 32, change "atmosphere" to -- atmosphere. --.
Line 40, change "remains" to -- remain --.

Column 27,
Line 4, change "becomes have" to -- has --.
Line 17, change "23B, 23C" to -- 22B, 22C --.
Lines 18 and 19, change "taken on line A-A of FIG. 21A, B-B of FIG. 21B, C-C of FIG. 21B and D-D of FIG. 21B" should read -- of FIGS. 21A, 21B, 21C and 21D --.
Line 24, change "off" to -- of --.
Line 32, change "are" to -- is --.
Line 38, change "or" to -- of --.
Line 62, change "a" to -- an --.

Column 28,
Line 1, change "Face" to -- face --.
Line 35, change "are" to -- that is --.

UNITED STATES PATENT AND TRADEMARK OFFICE

CERTIFICATE OF CORRECTION

PATENT NO. : 5,784,088
DATED : July 21, 1998
INVENTOR(S) : Toshihiko Ujita, Masanori Takenouchi and Keiichiro Tsukuda It is certified that error appears in the above-identified patent and that said Letters Patent is hereby corrected as shown below:

Column 29,
Line 6, change "ink" to -- ink. --.
Line 14, change "in FIGS." to -- FIGS. --.
Line 23, change "out side" to -- outside --.
Line 40, change "Slidable" to -- slidably --; and, change "rotatable" to -- rotatably --.

Column 30,
Line 1, after "will" insert -- be --.
Line 14, change "20" to -- 20. --.
Line 22, change "The" to -- In the --.
Line 23, change "15" to -- is --.
Line 25, change "head" to -- heads --.
Line 26, change "is" to -- are --.
Line 27, change "1" to -- 1. --.
Line 32, change "n." to -- in --.
Line 64, change "or" to -- of --.

Column 31,
Line 35, change "provide" to -- provided --.
Line 43, change "there fore" to -- therefore --.
Line 61, change "or" to -- of --.
Line 63, change "portions" to -- portion. --.

Column 32,
Line 3, after "plurality" insert -- of --; and change "head" to -- heads --.
Line 4, after "invention" delete “,”.
Line 5, change "an" to -- on --.
Line 9, change "container" to -- container. --.
Line 11, change "are" to -- is --.
Line 12, change "invention" to -- invention.--.
Line 20, change "As a regard" to -- As regards --.

UNITED STATES PATENT AND TRADEMARK OFFICE

CERTIFICATE OF CORRECTION

PATENT NO. : 5,784,088 
DATED : July 21, 1998
INVENTOR(S) : Toshihiko Ujita, Masanori Takenouchi and Keiichiro Tsukuda It is certified that error appears in the above-identified patent and that said Letters Patent is hereby corrected as shown below:

Column 35,
Line 42, change "ink 3inducing" to -- ink-inducing --.
Line 53, delete "to".

Column 36,
Line 50, after "element" insert -- is --.

Signed and Sealed this

Twenty-fifth Day of March, 2003

JAMES E. ROGAN
*Director of the United States Patent and Trademark Office*